US011479867B2

(12) United States Patent
Lin et al.

(10) Patent No.: US 11,479,867 B2
(45) Date of Patent: Oct. 25, 2022

(54) ELECTROCATALYTIC ALKENE DIAZIDATION

(71) Applicant: Cornell University, Ithaca, NY (US)

(72) Inventors: Song Lin, Ithaca, NY (US); Niankai Fu, Ithaca, NY (US); Gregory Stuart Sauer, Ithaca, NY (US)

(73) Assignee: CORNELL UNIVERSITY, Ithaca, NY (US)

( * ) Notice: Subject to any disclaimer, the term of this patent is extended or adjusted under 35 U.S.C. 154(b) by 115 days.

(21) Appl. No.: 16/431,265

(22) Filed: Jun. 4, 2019

(65) Prior Publication Data

US 2019/0368057 A1 Dec. 5, 2019

Related U.S. Application Data

(60) Provisional application No. 62/680,165, filed on Jun. 4, 2018.

(51) Int. Cl.
*C25B 3/23* (2021.01)
*C25B 3/09* (2021.01)

(52) U.S. Cl.
CPC ..... *C25B 3/23* (2021.01)

(58) Field of Classification Search
CPC ..... C25B 3/23; C25B 3/09; C07C 247/02
USPC ..... 205/432, 435, 436, 437; 552/11
See application file for complete search history.

(56) References Cited

U.S. PATENT DOCUMENTS 4,933,470 A 6/1990 Jones
5,364,522 A 11/1994 Wang

FOREIGN PATENT DOCUMENTS

WO 2017/117198 A1 7/2017

OTHER PUBLICATIONS

Wendt, "The Reactivity of Primary Free Radicals and Radical Ions, Mass Transfer, and Electrosorption—The Fundamental Factors for Selectivity in Electrochemical Syntheses of Organic Compounds," Angewandte Chemie International Edition in English (Apr. 1982), vol. 21, No. 4, pp. 256-270. (Year: 1982).*
"Chapter IV NaIO4—NaN3-Mediated Diazidation of Alkenes and Cu(I)-Catalyzed Synthesis of gem-Ditriazoles", pp. 182-204 (2016).
Fristad, W.E., et al., "Conversion of Alkenes to 1,2-D azides and 1,2-Diamines", J. Org. Chem., vol. 50, pp. 3647-3649 (1985).
Fu, N., et al., "Metal-catalyzed electrochemical diaz dation of alkenes", Science, vol. 357, pp. 575-579 (2017).
Yan, W., et al., "Electrochemical reg oselective azidoiodination of alkenes", Tetrahedron, vol. 73, pp. 764-770 (2017).
Parry, J.B., et al., "Electrocatalytic Difunctionalization of Olefins as a General Approach to the Synthesis of Vicinal Diamines", Synlett, vol. 29, pp. 257-265 (2018).
Fujimoto, K., et al., "Regioselective Azidomethoxylation of Enol Ethers by Anodic Oxidation", vol. 36, No. 41, pp. 7483-7486 (1995).
Schäfer, H., "Oxidative Additions of the Azide Ion to Olefins. A Simple Route to Diamines", Angew. Chem. Internat. Edit., vol. 9, No. 2, pp. 158-159 (1970).
Siu, J.C., et al., "Aminoxyl-Catalyzed Electrochemical Diazidation of Alkenes Mediated by a Metastable Charge-Transfer Complex", J. Am. Chem. Soc., vol. 141, pp. 2825-2831 (2019).

* cited by examiner

*Primary Examiner* — Edna Wong
(74) *Attorney, Agent, or Firm* — Heslin Rothenberg Farley & Mesiti P.C.

(57) ABSTRACT

Provided is an electrochemical reaction method that includes: immersing an anode and a cathode into a solution that includes azide ion ($N_3^-$), an alkene, and a transition metal catalyst; passing a current through the anode; and forming a diazide from the alkene. Related systems are also provided.

11 Claims, No Drawings

ELECTROCATALYTIC ALKENE DIAZIDATION

CROSS REFERENCE TO RELATED APPLICATIONS

This application claims the benefit of U.S. provisional application No. 62/680,165 filed Jun. 4, 2018, the disclosure of which is hereby incorporated by reference herein in its entirety.

STATEMENT REGARDING FEDERALLY SPONSORED RESEARCH OR DEVELOPMENT

This invention was made with government support under GM130928 awarded by the National Institutes of Health. The government has certain rights in the invention.

FIELD OF THE INVENTION

This invention relates to new and improved methods of preparing diazides.

BACKGROUND OF THE INVENTION

Diamines, e.g., vicinal diamines or 1,2-diamines, are a structural motif of pivotal significance to modern synthetic chemists. They are frequently found in multifarious pharmaceuticals and medicinally relevant natural products as well as in molecular catalysts for stereoselective synthesis. Despite substantial advances, a unified methodological approach to the synthesis of diamines remains elusive. The direct addition of two nitrogen-based functional groups to alkenes, a family of abundant, readily accessible, and structurally diverse feedstocks, constitutes a particularly powerful approach to diamine synthesis. Existing methods frequently require stoichiometric heavy metals (e.g., osmium or palladium) or esoteric nitrogenous reagents (e.g., nitrogen oxides, diaziridinones, N-activated sulfamides) and generally exhibit limited substrate scope.

Alkene diazidation represents an attractive alternative route to diamine synthesis. Further, organic azides are versatile intermediates for synthetic, materials, and biological applications. One non-limiting reagent for alkene diazidation is sodium azide ($NaN_3$). However, the nucleophilic nature of both alkenes and $N_3^-$ (azide ion) necessitates the use of a highly reactive oxidant to invert the polarity of one of the two substrates and thus enable CN coupling. As such, existing protocols uniformly employ stoichiometric quantities of reagents including peroxydisulfates, high-valent metal salts, or hypervalent iodines. The employment of such strongly oxidizing agents limits functional group compatibility, generates environmentally deleterious byproducts, and presents an explosion hazard when used alongside $NaN_3$.

Thus, a need exists for improved synthetic routes for obtaining diazides.

While certain aspects of conventional technologies have been discussed to facilitate disclosure of the invention, Applicant in no way disclaims these technical aspects, and it is contemplated that embodiments of the claimed invention may encompass one or more of the conventional technical aspects discussed herein.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

Briefly, the present invention satisfies the need for, inter alia, new and improved methods of preparing diazides.

The invention provides an efficient and convenient method for the conversion of an alkene to a diazide. Systems for making diazides are also disclosed. The diazides are useful for, e.g., synthesis of diamines via reduction. Further, diazides can participate in reactions such as 1,3-dipolar cycloadditions, the aza-Wittig reaction, Staudinger ligation, C—H bond amination, etc.

Embodiments of the invention may address one or more of the problems and deficiencies discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

Certain embodiments of the presently-disclosed methods and systems have several features, no single one of which is solely responsible for their desirable attributes. Without limiting the scope of the methods and systems as defined by the claims that follow, their more prominent features will now be discussed briefly. After considering this discussion, and particularly after reading the section of this specification entitled "Detailed Description of the Invention," one will understand how the features of the various embodiments disclosed herein provide a number of advantages over the current state of the art. These advantages may include, without limitation, providing a facile and efficient route to diazide formation, providing a one-step catalytic route to diazides formation, providing a method that decreases the likelihood of uncontrolled spontaneous nitrogen evolution compared to current methods, providing a method of forming diazides that can proceed under mild, ambient conditions, providing a method that exhibits broad substrate substitution patterns and functional group compatibility, enabling dual carbon-nitrogen bond formation (e.g., in a single synthetic step), providing an unusual combination of controlled reactivity and excellent chemoselectivity, allowing for diazidation of a substantially greater variety of alkenes than existing methods (e.g., with respect to substitution pattern and functional group compatibility), avoiding the need to use excessive quantities of reagents (e.g., high-valent transition metals such an Mn(III), Fe(III), PB(IV)), avoiding hazards that inhere to state of the art methods, and/or allowing for the abrupt cessation of the described reaction (which is provided for because, e.g., the described electrochemical reaction can be quickly ceased by simply stopping current flow to an anode that drives the catalytic cycle), etc.

In a first aspect, the invention provides a method of forming an azide, the method comprising:

immersing an anode and a cathode into a solution that includes azide ion ($N_3$), an alkene, and a transition metal catalyst;

passing a current through the anode; and forming a diazide from the alkene.

In a second aspect, the invention provides a system for making a diazides, the system comprising:

a reaction vessel;

a solution within the reaction vessel, wherein the solution includes azide ion, an alkene, and a catalyst;

an anode that is immersed in the solution;

a cathode that is immersed in the solution; and a power source that is connected to the anode to pass a current through the anode.

These and other objects, features, and advantages of this invention will become apparent from the following detailed description of the various aspects of the invention.

DETAILED DESCRIPTION

The present invention relates to, inter alia, methods of preparing diazides, and related systems.

Aspects of the present invention and certain features, advantages, and details thereof are explained more fully below with reference to the non-limiting embodiments discussed and illustrated in the accompanying drawings. Descriptions of well-known materials, fabrication tools, processing techniques, etc., are omitted so as to not unnecessarily obscure the invention in detail. It should be understood, however, that the detailed description and the specific examples, while indicating embodiments of the invention, are given by way of illustration only, and not by way of limitation. Various substitutions, modifications, additions and/or arrangements within the spirit and/or scope of the underlying inventive concepts will be apparent to those skilled in the art from this disclosure.

The headings used throughout this disclosure are provided for convenience and are not to be construed to limit the claims in any way. Embodiments under any heading may be combined with embodiments under any other heading.

Reference throughout the description to "one embodiment" or "an embodiment" or "some embodiments" means that a particular feature, structure or characteristic described in connection with the embodiment is included in at least that embodiment. Use of "one embodiment" or "an embodiment" or "some embodiments" throughout the description are not necessarily referring to the same embodiments; but particular features, structures, or characteristics may be combined in any suitable manner in one or more embodiments.

In a first aspect, the invention provides a method of forming an azide, the method comprising:

immersing an anode and a cathode into a solution that includes azide ion ($N_3$), an alkene, and a transition metal catalyst;

passing a current through the anode; and forming a diazide from the alkene.

In some embodiments, the source of the azide ion is a group 1A azide salt, e.g. $LiN_3$, $NaN_3$, $KN_3$. In some embodiments, the azide ion ($N_3$) is present via addition of an azide salt to the solution.

Embodiments of the inventive method utilize a transition metal catalyst. Prior to using the transition metal catalyst, Applicant undertook various unsuccessful attempts to electrochemically synthesize diazides from alkenes. These prior attempts suffered from an array of problems, including poor yield, sluggishness, poor regioselectivity, and formation of undesirable intermediates and byproducts.

Surprisingly, it has been found that embodiments of the inventive electrochemical methods that use a transition metal catalyst provide an unusual combination of high reactivity and excellent chemoselectivity, and, as such, are applicable to the diazidation of a substantially greater variety of alkenes than existing methods.

In some embodiments, the transition metal catalyst comprises manganese (Mn), copper (Cu), iron (Fe), nickel (Ni), and/or cobalt (Co).

In some embodiments, the transition metal catalyst does not comprise Mn(III), Fe(III), or PB(IV).

In some embodiments, the transition metal catalyst is a Mn(II) salt. For example, in some embodiments, the Mn(II) salt is manganese (II) bromide ($MnBr_2$).

In some embodiments, the transition metal catalyst, e.g., the Mn(II) salt, is present in a sub-stoichiometric quantity (i.e., a catalytic amount) relative to the amount of the alkene used in the method. Such embodiments use very different quantities of transition metal as compared to existing protocols that require stoichiometric quantities of reagents such as high-valent metal salts (e.g., Fristad et al., *J. Org. Chem.* 50, 3647-3649 (1985)).

In some embodiments, the quantity of the transition metal catalyst (e.g., Mn(II) salt) is approximately 0.1 to 200 mol % relative to the quantity of alkene (in other words, for each 1 mol of alkene, there is 0.001 to 1.0 mol. transition metal catalyst) (e.g., 0.1, 0.2, 0.3, 0.4, 0.5, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 135, 136, 137, 138, 139, 140, 141, 142, 143, 144, 145, 146, 147, 148, 149, 150, 151, 152, 153, 154, 155, 156, 157, 158, 159, 160, 161, 162, 163, 164, 165, 166, 167, 168, 169, 170, 171, 172, 173, 174, 175, 176, 177, 178, 179, 180, 181, 182, 183, 184, 185, 186, 187, 188, 189, 190, 191, 192, 193, 194, 195, 196, 197, 198, 199, or 200 mol % transition metal catalyst), including any and all ranges and subranges therein (e.g., 0.1 to 150 mol %, 0.1 to 99 mol %, 0.5 to 09 mol %, 0.5 to 95 mol %, 1 to 20 mol %, 2 to 15 mol %, 3 to 10 mol %, etc.). In some embodiments, the quantity of the transition metal catalyst is less than 100 mol % relative to the quantity of alkene.

Upon reviewing this disclosure, persons having ordinary skill in the art will readily recognize alkenes that are amenable to use in embodiments of the inventive methods, and it is contemplated that all such alkenes may be used in the presently-disclosed methods.

In some embodiments of the present invention, the alkene is a mono-substituted alkene substituted with functionalized substituents, for example, as described infra. In other embodiments, the alkene is a 1,1-disubstituted alkene substituted with functionalized substituents, e.g., as described infra. In yet other embodiments, the alkene is a 1,2-disubstituted alkene substituted with functionalized substituents, e.g., as described infra. In still other embodiments, the alkene is a 1,1,2-trisubstituted alkene substituted with functionalized substituents, e.g., as described infra. In other embodiments, the alkene is a 1,1,2,2-tetrasubstituted alkene substituted with, e.g., functionalized substituents as described infra.

Optionally, some embodiments of the present inventive method include a further electrolyte (used in addition to the source of azide ion). Examples of electrolytes include tetraalkylammonium salts and group 1A salts. For example, tetraalkylammonium salts may include tetrabutylammonium hexafluorophosphate ($TBAPF_6$) or tetrabutylammonium tetrafluoroborate ($TBABF_4$). One non-limiting example of a group 1A salt is lithium perchlorate ($LiClO_4$). Numerous other working electrolytes will be readily apparent to a person having ordinary skill in the art without departing from the scope of the present invention.

In some embodiments, the azide ion source itself serves as the electrolyte and a separate electrolyte is not required. For example, in some embodiments, addition of water allows the azide salt to serve as the electrolyte.

In embodiments of the present invention, a current is passed through an anode immersed in a solution that includes azide ion ($N_3$), an alkene, and a transition metal catalyst. In these embodiments a cathode is also present and a diazide is produced from the alkene starting material.

Embodiments of the inventive method are capable of proceeding to produce diazide reaction products under mild conditions, for example, conditions that include a temperature of less than or equal to 40° C.

In some embodiments of the presently-disclosed inventive methods, the method is performed at a reaction temperature of 15 to 80° C. (e.g., 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, or 80° C.), including any and all ranges and subranges therein (e.g., 15 to 40° C., 20 to 38° C., 21 to 30° C., 22 to 28° C., 22 to 40° C., etc.).

Anode and cathode materials are well known in the art. In some embodiments, the anode composition is chosen from materials such as carbon (e.g., graphite, reticulated vitreous carbon (RVC), etc), platinum, nickel, etc. However, it will be readily apparent to a person having ordinary skill in the art that numerous other anode materials may be employed without departing from the scope of the present invention.

In some embodiments, the anode composition is an inert conductive material. As used herein, "inert" is defined as a material that is not significantly transformed chemically during the reaction, i.e., a material that remains significantly unchanged during the reaction. In some embodiments, an inert conductive material is >99% chemically unreacted during the reaction. In some embodiments, an inert conductive material is >95% chemically unreacted during the reaction. It will be readily apparent to a person having ordinary skill in the art that numerous inert conductive materials may serve as an anode under the reaction conditions described herein.

In some embodiments, the cathode composition is chosen from materials such as carbon (e.g., graphite, reticulated vitreous carbon (RVC), etc), platinum, nickel, etc. However, it will be readily apparent to a person having ordinary skill in the art that numerous other cathode materials may be employed without departing from the scope of the present invention.

In some embodiments of the present invention, a current is passed through the anode that generates an anodic potential ($E_{anode}$) of approximately 0.5 volts (V) to approximately 1.0 V versus the ferrocenium ion/ferrocene redox couple (e.g., 0.50, 0.51, 0.52, 0.53, 0.54, 0.55, 0.56, 0.57, 0.58, 0.59, 0.60, 0.61, 0.62, 0.63, 0.64, 0.65, 0.66, 0.67, 0.68, 0.69, 0.70, 0.71, 0.72, 0.73, 0.74, 0.75, 0.76, 0.77, 0.78, 0.79, 0.80, 0.81, 0.82, 0.83, 0.84, 0.85, 0.86, 0.87, 0.88, 0.89, 0.90, 0.91, 0.92, 0.93, 0.94, 0.95, 0.96, 0.97, 0.98, 0.99, or 1.0 V), including any and all ranges and subranges therein (e.g., 0.5 to 0.7 V).

In some embodiments, the inventive method is performed in an electrochemical cell that is an undivided electrochemical cell. In other embodiments, the method is performed in a divided electrochemical cell.

In some embodiments, the inventive method results in a diazide % yield (of isolatable diazide) of at least 50% (e.g., at least 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, or 99%).

In some embodiments, the invention provides a method using electrochemistry for preparing a vicinal diazide (i.e., a 1,2-diazide) 2 from an alkene 1 as illustrated in the following scheme:

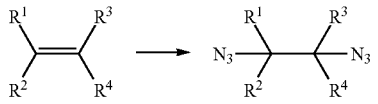

wherein $R^2$, $R^3$, and $R^4$ of alkene 1 are independently selected from hydrogen and other desired substituents, e.g., optional functionalized substituents such as substituents that include, but are not limited to, one or more of the following functional groups: an alcohol, an alkyl group, a cycloalkyl group, an aryl group, an aralkyl group, an aralkynyl group, a heteroaralkyl group, a —C(O)Oalkyl group, an aldehyde, a ketone, a carboxylic acid, an amine, a sulfide, an alkyne, ferrocene, an epoxide, an ester, an alkyl halide, an ether, a sulfonamide etc. In some embodiments, the foregoing substituent groups are optionally substituted themselves. In some embodiments, the method described herein provides diazide 2, wherein the $R^1$, $R^2$, $R^3$, and $R^4$ functionalized groups remain untransformed by the diazidation reaction. In some embodiments, the method of preparing diazides 2 from alkene 1 is performed in a single step reaction. As used herein, a "single step reaction" means that no isolable intermediate is formed.

In some embodiments, the invention provides a method using electrochemistry for preparing a diazide via cyclization of a diene in a reaction (e.g., a single step reaction), as illustrated in the following scheme:

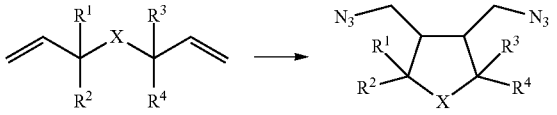

wherein $R^1$, $R^2$, $R^3$, and $R^4$ of dialkene 3 are as described supra and X is a carbon, oxygen, sulfur, or nitrogen atom that is optionally substituted, when possible, with functionalized substituents such as substituents that include, but are not limited to, one or more of the following functional groups: an alcohol, an aldehyde, a ketone, a carboxylic acid, an amine, a sulfide, an alkyne, ferrocene, an epoxide, an ester, an alkyl halide, an ether, a sulfonamide etc. In some embodiments, the method described herein provides diazide 4, wherein the $R^1$, $R^2$, $R^3$, $R^4$, and optionally substituted X functionalized groups remain untransformed by the diazidation reaction.

In other embodiments, the invention provides a method using electrochemistry for preparing a diazide via ringopening of a vinyl-substituted cyclopropane (e.g., in a single step reaction) as illustrated in the following scheme:

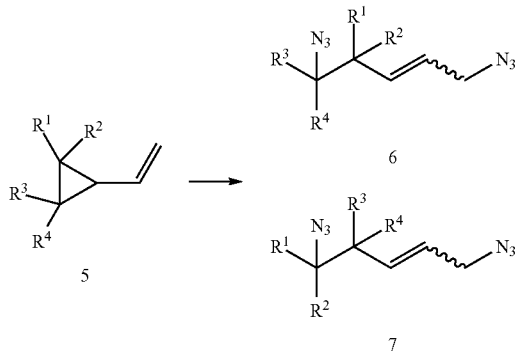

wherein $R^2$, $R^3$, and $R^4$ of vinyl-substituted cyclopropane 5 are as described supra. In some embodiments, the method described herein provides diazide 6 or 7, wherein the $R^2$, $R^3$, and $R^4$ functionalized groups remain untransformed by the diazidation reaction. The wavy bond shown for products 6 and 7 indicate that a mixture of both E- and Z-alkenes may be produced in the reaction.

In a second aspect, the invention provides a system for making a diazides, the system comprising:

a reaction vessel;

a solution within the reaction vessel, wherein the solution includes azide ion, an alkene, and a catalyst;

an anode that is immersed in the solution;

a cathode that is immersed in the solution; and a power source that is connected to the anode to pass a current through the anode.

In various embodiments, the inventive system is configured to run one or more embodiments of the method according to the first aspect of the invention.

EXAMPLES

The invention will now be illustrated, but not limited, by reference to the specific embodiments described in the following examples.

All reactions were performed in oven-dried two-neck glass tubes unless otherwise noted. The tubes were fitted with a rubber septum and a threaded Teflon cap with airtight, electrical feed-throughs. The reactions were conducted under a nitrogen atmosphere. Flash chromatography was performed using silica gel 60 (230-400 mesh) from SiliCycle.

Commercial reagents were purchased from Sigma Aldrich, Alfa Aesar, Acros, TCI, AK Scientific, and Oakwood and used as received with the following exceptions: toluene, dichloromethane, tetrahydrofuran, diethyl ether, and acetonitrile were dried by passing through columns of activated alumina; dimethylformamide was dried by passing through columns of activated molecular sieves. Triethylamine were distilled from $CaH_2$ at 760 torr.

Proton nuclear magnetic resonance CH NMR) spectra and carbon nuclear magnetic resonance ($^{13}C$ NMR) spectra were recorded on Mercury-300 (300 MHz), Inova-400 (400 MHz) and Inova-500 (500 MHz) spectrometers. Chemical shifts for protons are reported in parts per million downfield from tetramethylsilane and are referenced to residual protium in the NMR solvent ($CHCl_3$=δ 7.26). Chemical shifts for carbon are reported in parts per million downfield from tetramethylsilane and are referenced to the carbon resonances of the solvent ($CDCl_3$=δ 77.0). Data are represented as follows: chemical shift, multiplicity (br. s=broad, s=singlet, d=doublet, t=triplet, q=quartet, m=multiplet), coupling constants in Hertz (Hz), integration. Infrared (IR) spectra were obtained using a Bruker Hyperion Tensor 27 FTIR spectrometer. Cyclic voltammetry data were measured with a BASi Epsilon potentiostat. The mass spectral (MS) data were obtained on a Thermo Fisher Scientific Exactive series DART Mass Spectrometer.

Electrolysis experiments were performed using a BASi EC Epsilon potentiostat/galvanostat or a DC power supply. Reticulated vitreous carbon was purchased from ERG Aerospace. The carbon was cut into 1×0.5×0.6 $cm^3$ pieces before use and was connected to electrical feed-through on the Teflon cap of the electrochemical cell via a piece of graphite (2B pencil lead, 2 mm in diameter). $Ag/AgNO_3$ reference electrodes were obtained from CH Instruments and stored in an acetonitrile solution with 0.01 M $AgNO_3$ and 0.1 M $LiClO_4$ before use.

Organic azides are known to be potentially explosive compounds. All azidation reactions and subsequent workups should be performed behind a blast shield. Once isolated, organic azides should be stored below room temperature and away from sources of heat, light, pressure and shock.

Abbreviations

Boc—tert-butyl carbamate, $^n$Bu—n-butyl, $^t$Bu—tert-butyl, DIBAL—diisobutylaluminium hydride, DCM—dichloromethane, DMSO—dimethyl sulfoxide, EtOAc—ethyl acetate, HOAc—acetic acid, LDA—lithium diisopropylamide, MeCN—acetonitrile, MeOH—methanol, $NEt_3$—triethylamine, RVC—reticulated vitreous carbon, $PPh_3$—triphenylphosphine, $^i$Pr—isopropyl, TBA—tetrabutylammonium, TBS—tert-butyldimethylsilyl, TEMPO—(2,2,6,6-tetramethylpiperidin-1-yl)oxyl, THF—tetrahydrofuran, TPP—meso-tetraphenylporphyrinato, Ts—p-toluenesulfonyl.

General Method A (Mg Scale)

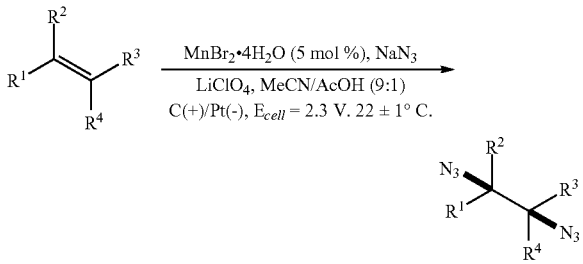

An oven-dried, 10 mL two-neck glass tube was equipped with a magnetic stir bar, a rubber septum, a threaded Teflon cap fitted with electrical feed-throughs, an RVC anode (connected to the electrical feed-through via a 9 cm in length, 2 mm in diameter graphite rod), and a platinum foil cathode (0.5×1.0 $cm^2$). To this reaction vessel was added $MnBr_2.4H_2O$ (2.86 mg, 5 mol %) and $NaN_3$ (65.0 mg, 1.0 mmol, 5.0 equiv). The cell was sealed and flushed with nitrogen gas for 5 minutes, followed by the sequential addition via syringe of olefin substrate (0.2 mmol, 1.0 equiv), electrolyte solution (0.1 M $LiClO_4$ in MeCN, 3.5 mL), and acetic acid (0.4 mL). The reaction mixture was then purged with nitrogen gas for another 5 minutes. A nitrogen-filled balloon was adapted through the septum to sustain a nitrogen atmosphere. Electrolysis was initiated at a cell potential of 2.3 Vat room temperature (22±1° C.). Upon full consumption of olefin starting material as determined by thin-layer chromatography analysis, the electrical input was removed. The entire reaction mixture was then transferred to a short silica gel column (7-10 cm in length, ca. 10 g) and flushed through with 100 mL of a mixture of hexanes and ethyl acetate to eliminate the inorganic salts, and the product solution was concentration in vacuo. In many cases, the crude product was spectroscopically pure. Otherwise, the residue was subjected to flash column chromatography on silica gel (eluted with hexanes/ethyl acetate) to yield the purified product.

General Method B (Gram Scale)

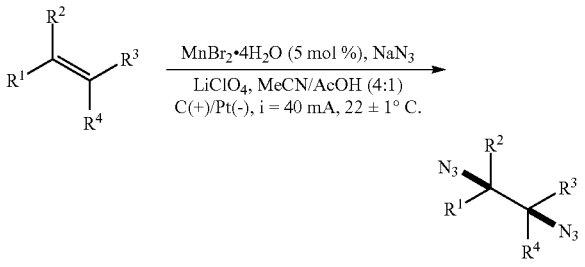

To an oven-dried three neck round bottom flask (50 mL) equipped with a magnetic stirbar was added sodium azide (0.975 g, 15 mmol, 5 equiv) and $MnBr_2.4H_2O$ (43 mg, 0.15 mmol, 0.05 equiv). Each neck was fitted with a rubber septum. The septa on the side necks were fitted with a RVC anode (1.0 cm in diameter and 1.5 cm in length, connected to a 9 cm in length, 2 mm in diameter graphite rod), and a platinum foil cathode (2.5×1.5 cm), the lower (closest) ends of the electrodes was 0.5 cm. The cell was sealed and flushed with nitrogen gas for 5 minutes, followed by the addition via syringe of electrolyte solution (0.1 M $LiClO_4$ in MeCN, 24 mL), olefin substrate (3.0 mmol, 1.0 equiv), and acetic acid (6.0 mL). The reaction mixture was then purged with nitrogen gas for another 5 minutes. A nitrogen-filled balloon was adapted through a septum to sustain a nitrogen atmosphere. Electrolysis was initiated at a constant current of 40 mA at room temperature (for terminal aliphatic alkenes, a constant current of 50 mA at 40° C. was applied). Upon full consumption of olefin starting material as determined by thin-layer chromatography analysis, the electrical input was removed. The entire reaction mixture was then transferred to a short silica gel column (7-10 cm in length, ca. 50 g) and flushed through with a mixture of hexanes and ethyl acetate to eliminate the inorganic salts. After concentration in vacuo, the residue was then dissolved in EtOAc and washed with $NaHCO_3$ (aq.) (3×50 mL), and then brine (50 mL). The organic layer was dried over $Na_2SO_4$ and then concentrated in vacuo to yield the product, which was spectroscopically pure.

General Method C (Sodium Azide as Electrolyte)

To an oven-dried two neck round bottom flask (100 mL) equipped with a magnetic stir bar was added $NaN_3$ (16.25 g, 250 mmol, 2.5 equiv) and $MnBr_2.4H_2O$ (1.434 g, 5 mmol, 0.05 equiv). Each neck was fitted with a rubber septum. The septa on the side necks were fitted with a carbon felt anode 1.5 cm×6 cm anode connected to a 9 cm pencil lead in length, 2 mm in diameter graphite rod), and a platinum mash cathode (4×6 cm), the lower (closest) ends of the electrodes was 0.5 cm. Then MeCN (80 ml), water (13 ml; addition of water allows for $NaN_3$ to serve as the sole electrolyte) and AcOH (13 ml) was added and stirred. The cell was sealed and solution purged with nitrogen gas for 10 minutes. While the solution is being purged, connect the positive leads of the DC power supply to the graphite rod and connect the negative leads to the platinum electrode. After purging is complete, 2,3-dimethylbut-2-ene (8.533 g, 100 mmol, 1 equiv) was injected through the septum. Electrolysis was started after all the $MnBr_2$ was dissolved in the MeCN layer, a homogenous organic layer was formed. The electrolysis condition was constant current of 100 mA (4.50 V max cell voltage) over 67 hours (2.5 equiv of electrons) or until organic layer clears (lack of azide in solution). The presence of a black manganese complex in the organic layer is a good indication that the reaction is progressing well. Initially it takes around 30 minutes for the black colour to build for such a large scale. A balloon was then attached to on the of the septum to collect the $H_2$ gas. A protective atmosphere is not necessary once the solution is black. When enough charge has passed through the system, the electrical input was removed. The entire reaction mixture was then transferred to a separatory where 50 ml of water was added. Ether was then used to extract (2×150 ml) the aqueous layer and then washed with $NaHCO_3$ (2×50 ml). Dried with $Na_2SO_4$ and concentrated at a water bath temperature no higher than 40° C. and lowest pressure of 95 torr. A light yellow liquid (16.368 g, 97%) with purity sufficient for the next step was obtained. If the diazide is the desire product, a short silica plug (flushed with 20% ether and pentane) can be used to give spectroscopically pure product.

TABLE 1

Alkene diazidation under various different conditions.

| Entry | Variation from standard conditions* | Conversion† (%) | Yield† (%) |
|---|---|---|---|
| 1 | None | >99 | >99 (90)‡ |
| 2 | Constant electrode potential at 0.72 V | >99 | 86 [66]§ |
| 3 | Controlled current at 8 mA | >99 | 90 [87]§ |
| 4 | No externally applied potential | <5 | <5 |
| 5 | Graphite as cathode instead of Pt | >99 | 82 |
| 6 | Two AA batteries (3 V) as power source | >99 | 69 |
| 7 | $FeBr_2$ instead of $MnBr_2$ | 95 | <10 |
| 8 | $Cu(OAc)_2$ instead of $MnBr_2$ | >99 | 85 |
| 9 | $Ni(OAc)_2$ instead of $MnBr_2$ | 83 | <10 |
| 10 | $Mn(OTf)_2$ instead of $MnBr_2$ | >99 | 95 |
| 11 | Mn(TPP) instead of $MnBr_2$ | >99 | 64 |
| 12 | $TBAPF_6$ instead of $LiClO_4$ | >99 | 97 |
| 13 | Reused RVC electrode, no Mn catalyst‖ | 15 | <5 |
| 14 | No Mn catalyst | >99 | <10 |

*Standard conditions: 0.2 mmol alkene, 0.01 mmol $MnBr_2$•$4H_2O$, 1.0 mmol $NaN_3$, 400 μL HOAc, 3.5 mL $LiClO_4$ solution in MeCN (0.1 μM), RVC as anode, Pt as cathode, under $N_2$, at room temperature, in a one-compartment cell, at 2.3 V applied cell potential, 2.5 h.
†NMR conversion and yield determined using 1,3,5-trimethoxybenzene as the internal standard. ‡Value in parenthesis indicates the isolated yield. §Value in brackets indicates the Faradaic efficiency.
‖RVC electrode from a previous reaction under the standard conditions is recovered, washed with MeCN, and reused in a separate reaction instead of a new RVC. No $MnBr_2$•$4H_2O$ was added.

Current Efficiency of Reaction with Representative Substrates.

Current efficiencies (Faradaic efficiencies) were measured using Method A or Method B as shown below with the following modifications. For Method A (0.2 mmol olefin substrate), a constant current of 8 mA was applied and the reaction was allowed to proceed for 80 min before the current was withdrawn (this corresponds to a total of 2 F of charge passed). For Method B (3 mmol olefin substrate), a constant current of 40 mA was applied and the reaction was allowed to proceed for 4 h before the current was withdrawn (2 F of total charge passed). Assuming that the overall reaction is a 2-electron oxidation process, the Faradaic efficiency (FE) thus equals to the percentage yield.

Current Efficiency of Reaction for Method a (0.2 Mmol Scale):

1b

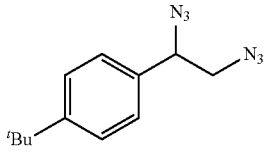

(FE = 87%)

9b[a]

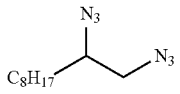

(FE = 94%)

16b[a]

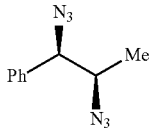

(FE = 57%)

30b

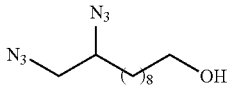

(FE = 73%)

31b

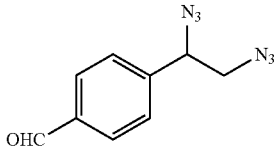

(FE = 83%)

38b

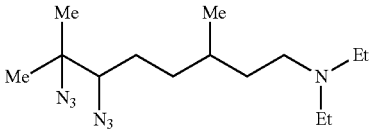

(FE = 99%)

39b

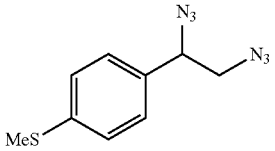

(FE = 92%)

-continued

42b

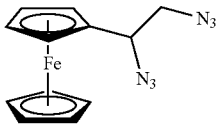

(FE = 89%)

Current Efficiency of Reaction for Method B (3 Mmol Scale):

1b

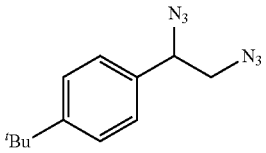

(FE = 92%)

22b

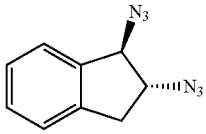

(FE = 90%)

27b

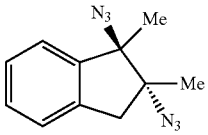

(FE = 75%)

33b[a]

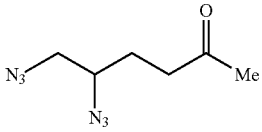

(FE = 65%)

46b[b]

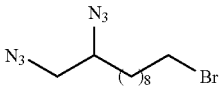

(FE = 62%)

[a]Reaction at 40 C. [b]Constant current of 50 mA, passing 2.5 F of charge.

In general, alkene substrates were purchased from commercial sources and used as received. Other substrates are synthesized according literature procedures with minor modifications when necessary as shown below:

General Method D (Synthesis of Alkene Substrates Via Methylenation Using Wittig Reaction)

An oven-dried round-bottom flask was charged with $MePPh_3Br$ (1.3 equiv) and THF (carbonyl substrate concentration=0.2 M). KOtBu (1.4 equiv) was added to the suspension at 0° C. The resulting mixture was allowed to warm up to room temperature and stirred for 1 h. The yellow suspension was cooled to 0° C. again followed by portion-wise addition of the carbonyl substrate (1 equiv). The reaction progress was monitored by thin-layer chromatography. Upon completion (usually between 1-12 h), hexanes was added to precipitate triphenylphosphine oxide, which was subsequently removed by filtration. The filtrate was concentrated in vacuo, and the product was separated from the residue by flash column chromatography using hexanes or hexanes/ethyl acetate.

Data for Alkene Substrates Made Via Method D:

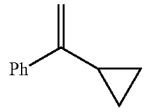

(1-Cyclopropylvinyl)benzene

Following Method D. $^1$H NMR: (400 MHz, $CDCl_3$) δ 7.73-7.47 (m, 2H), 7.39-7.31 (m, 2H), 7.31-7.27 (m, 1H), 5.28 (d, J=1.2 Hz, 1H), 4.93 (d, J=1.3 Hz, 1H), 1.65 (tt, J=7.4, 5.9 Hz, 1H), 0.94-0.74 (m, 2H), 0.68-0.44 (m, 2H).

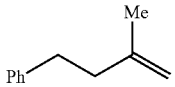

(3-Methylbut-3-en-1-yl)benzene

Following Method D. $^1$H NMR: (400 MHz, $CDCl_3$) δ 7.30-7.23 (m, 2H), 7.2-7.14 (m, 3H), 4.72 (s, 1H), 4.69 (s, 1H) 2.85-2.63 (m, 2H), 2.42-2.21 (m, 2H), 1.76 (s, 3H).

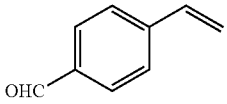

4-Vinylbenzaldehyde

Following Method D with these modifications: $K_2CO_3$ was used as the base instead of KO$^t$Bu, and the final reaction mixture was heated at reflux for 20 h before workup. $^1$H NMR: (300 MHz, $CDCl_3$) δ 9.96 (s, 1H), 7.81 (d, J=8.2 Hz, 2H), 7.52 (d, J=8.2 Hz, 2H), 6.74 (dd, J=17.6, 10.9 Hz, 1H), 5.89 (d, J=17.6 Hz, 1H), 5.41 (d, J=10.9 Hz, 1H).

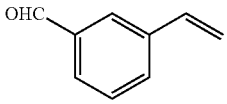

3-Vinylbenzaldehyde

Following Method D with these modifications: $K_2CO_3$ was used as the base instead of KO$^t$Bu, and the final reaction mixture was heated at reflux for 20 h before workup. $^1$H NMR: (300 MHz, $CDCl_3$) δ 10.00 (s, 1H), 7.89 (s, 1H), 7.74 (d, J=7.5 Hz, 1H), 7.64 (d, J=7.7 Hz, 1H), 7.47 (t, J=7.6 Hz, 1H), 6.75 (dd, J=17.6, 10.9 Hz, 1H), 5.84 (d, J=17.6 Hz, 1H), 5.35 (d, J=10.9 Hz, 1H).

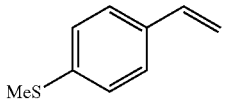

Methyl(4-vinylphenyl)sulfane

Following Method D. $^1$H NMR: (500 MHz, $CDCl_3$) δ 7.33 (m, 2H), 7.21 (m, 2H), 6.67 (dd, J=17.6, 10.9 Hz, 1H), 5.71 (dd, J=17.6, 0.9 Hz, 1H), 5.21 (dd, J=10.9, 0.9 Hz, 1H), 2.49 (s, 3H).

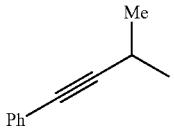

(3-Methylbut-3-en-1-yn-1-yl)benzene

Following Method D. $^1$H NMR: (300 MHz, $CDCl_3$) δ 7.52-7.40 (m, 2H), 7.38-7.27 (m, 3H), 5.47-5.35 (m, 1H), 5.34-5.22 (m, 1H), 2.05-1.93 (m, 3H).

General Method E (Synthesis of Alkene Substrates Via Isopropylenation Using Wittig Reaction An oven-dried round-bottom flask was charged with $^i$PrPPh$_3$Br (1.0 equiv) and THF (carbonyl substrate concentration=0.1 M). $^n$BuLi (1.6 M in hexanes, 1.0 equiv) was added to the suspension at 0° C. The resulting mixture was allowed to warm up to room temperature and stirred for 1 h. The suspension was cooled to 0° C. again followed by portion-wise addition of the carbonyl substrate (1 equiv). The reaction was allowed to proceed with stirring overnight. Upon completion, hexanes was added to precipitate triphenylphosphine oxide, which was subsequently removed by filtration. The filtrate was concentrated in vacuo, and the product was separated from the residue by flash column chromatography using hexanes or hexanes/EtOAc.

Data for Alkene Substrates Made Via Method E:

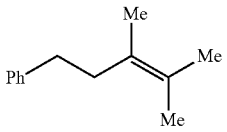

(3,4-Dimethylpent-3-en-1-yl)benzene

Following Method E. $^1$H NMR: (400 MHz, $CDCl_3$) δ 7.30-7.24 (m, 2H), 7.2-7.15 (m, 3H), 2.68-2.60 (m, 2H), 2.35-2.27 (m, 2H), 1.68 (s, 3H), 1.64 (s, 3H), 1.58 (s, 3H).

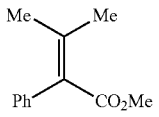

Methyl 3-methyl-2-phenylbut-2-enoate

Following Method E. $^1$H NMR: (300 MHz, $CDCl_3$) δ 7.43-7.27 (m, 3H), 7.22-7.05 (m, 2H), 3.67 (s, 3H), 2.14 (s, 3H), 1.69 (s, 3H).

Method F (Synthesis of 1-Allyl-1H-benzo[d]imidazole)

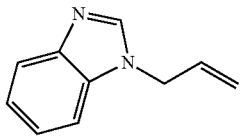

1-Allyl-1H-benzo[d]imidazole

To an oven-dried round-bottom flask was added benzimidazole (1.2 g, 10 mmol, 1.0 equiv) and THF (30 mL). The solution was cooled to 0° C. and stirred. To this solution was slowly added NaH (0.8 g, 20 mmol, 2.0 equiv, 60% in mineral oil). Subsequently, the resulting mixture was allowed to warm to room temperature and stirred for 15 min. To this mixture was added allyl bromide (1.04 mL, 12 mmol, 1.2 equiv). The mixture was then heated to reflux and monitored by TLC for disappearance of benzimidazole. Upon completion, the reaction was quenched with $H_2O$, and the resulting solution concentrated in vacuo. The resulting oil was dissolved in DCM and washed with $H_2O$ and brine. The combined organic extracts were dried and concentrated in vacuo, and the product was purified by flash column chromatography using hexanes/EtOAc. $^1$H NMR: (300 MHz, $CDCl_3$) δ 7.77-7.54 (m, 2H), 7.20-6.96 (m, 3H), 5.72-5.59 (m, 1H), 4.98 (dd, J=10.3, 1.0 Hz, 1H), 4.86 (dd, J=17.1, 1.0 Hz, 1H), 4.45-4.30 (m, 2H).

Method G (Synthesis of Benzyl Prenyl Ether)

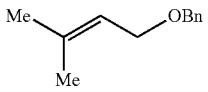

Benzyl Prenyl Ether

To an oven-dried round-bottom flask was added NaH (1.2 g, 30 mmol, 1.36 equiv, 60% in mineral oil) and THF (77 mL). The solution was cooled to 0° C. and stirred under $N_2$. To this solution was slowly added benzyl bromide (2.6 mL, 22 mmol, 1 equiv) in one portion followed by prenol (2.3 mL, 23 mmol, 1.05 equiv) dropwise. The reaction mixture was stirred overnight and then quenched by addition of 35 mL $H_2O$. The organic layer was separated, and the aqueous layer was extracted three times with hexanes. The combined organic layers were washed with brine before drying over anhydrous sodium sulfate. The product was purified by flash column chromatography using 97% hexanes/3% EtOAc to yield the title compound as a pale yellow oil (3.85 g, 99% yield). $^1$H NMR: (300 MHz, $CDCl_3$) δ 7.50-7.19 (m, 5H), 5.45-5.40 (m, 1H), 4.52 (s, 2H), 4.02 (d, J=6.9 Hz, 2H), 1.77 (s, 3H), 1.67 (s, 3H).

Method H (Synthesis of 2,3-Dimethyl-1H-indene)

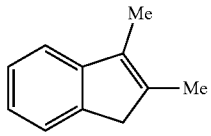

2,3-Dimethyl-1H-indene

To a solution of 2-methyl-1-indanone (2.0 g, 13.7 mmol, 1 equiv) in diethyl ether (68 mL) was added MeMgBr (3 M in ether, 6.8 mL, 20.5 mmol, 1.5 equiv) dropwise at 0° C. and the mixture was stirred for 6 h at room temperature. Upon completion, the reaction was cooled to 0° C. and treated with 2 M HCl (10 mL). The mixture was stirred overnight and then extracted three times with diethyl ether. The organic layers were combined, washed with brine twice, dried over anhydrous $Na_2SO_4$, and concentrated under reduced pressure to give the crude product. Purification by flash column chromatography with hexanes furnished the title compound as a colorless liquid. $^1$H NMR: (400 MHz, $CDCl_3$): δ 7.37 (d, J=7.3 Hz, 1H), 7.29-7.21 (m, 2H), 7.14-7.10 (m, 1H), 3.26 (s, 2H), 2.07 (s, 3H), 2.04 (d, J=0.8 Hz, 3H).

Method I (Synthesis of 1-Tosyl-1H-indole)

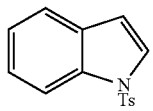

1-Tosyl-1H-indole

To an oven-dried round bottom flask cooled while being purged with $N_2$ was added NaH (0.512 g, 12.75 mmol, 1.5 equiv). THF (30 mL) was then added and a drying tube with $CaSO_4$ was applied to the round bottom flask. The mixture was stirred for 5 minutes before the addition of indole (1.00 g, 8.5 mmol, 1.0 equiv). The mixture was stirred for another 30 minutes before the dropwise addition of toluenesulfonyl chloride (1.8 g, 9.35 mmol, 1.1 equiv) dissolved in an additional 20 mL of dry THF over 5 minutes. The reaction was run overnight before being quenched with water (30 mL). The mixture was allowed to stir an additional 5 minutes before transferring to a separatory funnel and extracting twice with ethyl acetate. The organic layers were washed three times with sat. sodium bicarbonate, and once with brine before drying over anhydrous sodium sulfate. The organic layers were then concentrated and purified via flash column chromatography with (90% hexanes/10% EtOAc), yielding the product as a white/pink solid (2.1 g, 91% yield). $^1$H NMR: (300 MHz, $CDCl_3$) δ 7.99 (d, J=8.3 Hz, 1H), 7.76 (d, J=8.4 Hz, 2H), 7.56 (d, J=3.6 Hz, 1H), 7.52 (d, J=7.9 Hz, 1H) 7.35-7.16 (m, 4H), 6.65 (d, J=3.6 Hz, 1H), 2.33 (s, 3H).

Method J (Synthesis of 3-Vinyl-3-deoxyestrone)

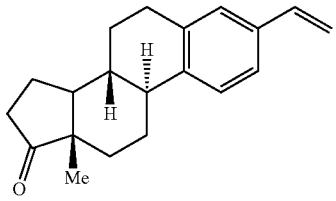

3-Vinyl-3-deoxyestrone. An oven-dried 100 mL round-bottom flask was charged with estrone (0.50 g, 1.85 mmol, 1.0 equiv), $CH_2Cl_2$ (9 mL), and $NEt_3$ (0.52 mL, 3.70 mmol, 2.0 equiv). The mixture was cooled to 0° C., and $Tf_2O$ (0.34 mL, 2.04 mmol, 1.1 equiv) was added over ca. 3 min. The mixture was allowed to warm to room temperature and stirred at room temperature under $N_2$ for 3 h. The resulting brown mixture was diluted with $CH_2Cl_2$, washed with saturated aqueous $NH_4Cl$, and the aqueous layer was extracted twice with $CH_2Cl_2$. The combined organic layers were dried over $Na_2SO_4$, and the filtrate was concentrated. The crude was purified with column chromatography to afford 3-(trifluoromethanesulfonyl)estrone as a white solid. A 25 mL Straus flask was charged with 3-(trifluoromethanesulfonyl)estrone (0.40 g, 1.0 mmol, 1.0 equiv), potassium vinyltrifluoroborate (133 mg, 1.0 mmol, 1.0 equiv), $PdCl_2$ (3.5 mg, 0.02 mmol, 2 mol %), $Cs_2CO_3$ (0.977 g, 3.0 mmol, 3.0 equiv), and the tube was brought into a $N_2$-filled glovebox. $PPh_3$ (16 mg, 0.06 mmol, 6 mol %) and 1.8 mL THF were added, and the tube was sealed and removed from the glovebox. 0.2 mL $H_2O$ (sparged with $N_2$ before use) was added against a $N_2$ flow, and the mixture was stirred at 85° C. for 19 h. The resulting dark brown mixture was allowed to cool to room temperature, diluted with DCM, and washed with water. The aqueous layer was extracted with three times with DCM. The combined organic layers were dried over $Na_2SO_4$, and the filtrate was concentrated. The crude was purified with flash column chromatography to afford 3-vinyl-3-deoxyestrone as a white solid. $^1H$ NMR: (300 MHz, $CDCl_3$) δ 8.27-7.84 (m, 3H), 7.52 (dd, J=17.7, 10.7 Hz, 1H), 6.55 (d, J=17.6 Hz, 1H), 6.04 (d, J=10.8 Hz, 1H), 3.89-3.61 (m, 2H), 3.48-2.69 (m, 7H), 2.60-2.16 (m, 6H), 1.76 (s, 3H).

Method K (Synthesis of Undec-10-en-1-amine)

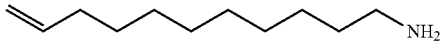

Undec-10-en-1-amine $NaN_3$ (1.2 g, 17.2 mmol, 2 equiv) was added to a solution of 11-bromo-1-undecene (2.0 g, 8.6 mmol, 1 equiv) in DMSO (20 mL) and the mixture was stirred at room temperature for 10 min followed by heating at 60° C. for 2 h. The reaction mixture was then cooled to room temperature followed by addition of brine (20 mL). The organic layer was extracted with dichloromethane and the combined organic extracts were dried over $Na_2SO_4$. Evaporation of solvent gave the crude product as yellow oil, which was purified using silica gel column to yield 11-azidoundec-1-ene. $PPh_3$ (2.3 g, 8.6 mmol, 1 equiv) was added to the solution of 11-azidoundec-1-ene in THF (40 mL) under $N_2$ atmosphere and the reaction mixture was stirred at room temperature for 2 h. After that, 155 μL of $H_2O$ was added to the reaction mixture, which was stirred at room temperature for 30 min. The reaction mixture was then refluxed till no more starting material was observed using thin-layer chromatography. The mixture was allowed to cool to room temperature. Solvent was evaporated and the residue was directly purified with silica gel chromatography to give the undec-10-en-1-amine. $^1H$ NMR: (300 MHz, $CDCl_3$) δ 5.81-5.67 (m, 1H), 4.95-4.85 (m, 2H), 3.56 (s, 2H), 2.65 (t, J=7.2 Hz, 2H), 2.01-1.90 (m, 2H), 1.55-1.14 (m, 14H).

Method L (Synthesis of N,N-Diethyl-3,7-dimethyloct-6-en-1-amine)

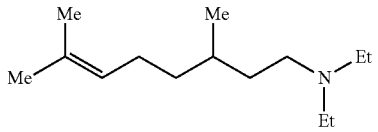

N,N-Diethyl-3,7-dimethyloct-6-en-1-amine

To an oven-dried round-bottom flask was added citronellal (2.0 mL, 11 mmol, 1 equiv), diethylamine (1.76 mL, 17 mmol, 1.5 equiv), and dichloroethane (36 mL). sodium triacetoxyborohydride (3.6 g, 17 mmol, 1.5 equiv) was added to the mixture, which was subsequently stirred overnight. The reaction was quenched with 2 M aqueous NaOH, and the aqueous layer was separated and extracted with ether three times. The combined organic layers were washed with brine, dried over $Na_2SO_4$, and concentrated. The crude product was purified with flash column chromatography on aluminum oxide to afford the title compound as a colorless liquid. $^1H$ NMR: (400 MHz, $CDCl_3$) δ 5.09 (t, J=7.1 Hz, 1H), 2.60-2.46 (m, 4H), 2.46-2.34 (m, 2H), 2.09-1.84 (m, 2H), 1.68 (s, 3H), 1.60 (s, 3H), 1.54-1.10 (m, 5H), 1.01 (t, J=7.1 Hz, 6H), 0.88 (d, J=6.4 Hz, 3H).

Method M (Synthesis of 2-(But-3-en-1-yl)-2-methyloxirane)

2-(But-3-en-1-yl)-2-methyloxirane

To a solution of KO$^t$Bu (6.72 g, 60 mmol, 1.0 equiv) in dimethylsulfoxide (60 mL) at room temperature was added trimethylsulfoxonium iodide (14.5 g, 66 mmol, 1.1 equiv) and stirred for 30 min. A solution of 5-hexen-2-one (5.88 g, 60 mmol, 1 equiv) in dimethylsulfoxide (20 mL) was added and stirred overnight. The reaction mixture was diluted with EtOAc and water and the layers were separated. The aqueous layer was extracted with EtOAc. The combined organic layers were washed with brine and dried over $Na_2SO_4$. The solvent was removed under reduced pressure to provide the title compound as a colorless liquid. $^1H$ NMR: (300 MHz, $CDCl_3$): δ 5.80 (ddt, J=16.8, 10.2, 6.6 Hz, 1H), 5.02 (dd, J=17.1, 1.7 Hz, 1H), 4.95 (dd, J=10.2, 1.6 Hz, 1H), 2.61 (d, J=4.8 Hz, 1H), 2.56 (d, J=4.8 Hz, 1H), 2.20-2.09 (m, 2H), 1.69 (dt, J=15.5, 7.7 Hz, 1H), 1.63-1.54 (m, 1H), 1.33 (s, 3H).

Method N (Synthesis of N,N-Diallyl-4-methylbenzenesulfonamide)

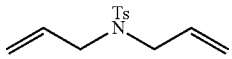

N,N-Diallyl-4-methylbenzenesulfonamide

To an oven-dried round bottom flask was added DCM (15 mL) and diallylamine (1.23 mL, 10 mmol, 1 equiv). $NEt_3$ (1.53 mL, 11 mmol, 1.1 equiv) was then added dropwise over 5 minutes. The mixture was allowed to stir for 30 minutes before the dropwise addition of 4-toluenesulfonyl chloride (2.097 g, 11 mmol, 1.1 equiv) dissolved in an additional 20 mL of DCM over 5 minutes. The reaction was run overnight before being transferred to a separatory funnel. The organic phase was washed once with a 1:2 dilution of saturated sodium bicarbonate with $H_2O$, twice with saturated sodium bicarbonate, and once with deionized water. The organic layer was dried over anhydrous $Na_2SO_4$ and concentrated. The residue was purified via flash column chromatography yielding the product as a clear liquid (1.7 g, 68% yield). $^1$H NMR: (500 MHz, $CDCl_3$) δ 7.73-7.68 (m, 2H), 7.30 (m, 2H), 5.61 (ddt, J=17.4, 9.8, 6.4 Hz, 2H), 5.19-5.08 (m, 4H), 3.80 (dt, J=6.2, 1.3 Hz, 4H), 2.43 (s, 3H).

Method O (Synthesis of trans-2-Phenyl-1-vinylcyclopropane)

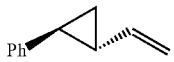

trans-2-Phenyl-1-vinylcyclopropane

To trans-2-phenyl-1-cyclopropane carboxylic acid (1.00 g, 6.2 mmol, 1 equiv) was added ether (20 mL) and MeOH (2 mL). Trimethylsilyldiazomethane (2 M in diethyl ether, 4.7 mL, 9.4 mmol, 1.5 equiv) was added to this mixture dropwise over 20 minutes. The reaction was stirred for 30 min before quenching with HOAc, after which the solvent was removed under vacuum. Methyl trans-2-phenyl-1-cyclopropane carboxylate was obtained (764 mg, 70% yield). This synthetic intermediate was dissolved in ether (5 mL) and cooled to −120° C. DIBAL (1 M in hexane, 6.5 mL, 6.5 mmol, 1.5 equiv) was added dropwise. After the addition was complete, methanol (3 mL) was added slowly followed by the addition of 10% Rochelle's salt (10 mL). The mixture was then allowed to warm up to room temperature and extracted with ether. The organic layer was then washed with 1 M HCl three times and brine twice, dried over $Na_2SO_4$, and evaporated to dryness. Purification by flash column chromatography (99% hexanes/1% EtOAc) afforded trans-(2-phenylcyclopropyl)formaldehyde (412 mg, 65% yield). This intermediate was subjected to the conditions in Method D to furnish trans-2-phenyl-1-vinylcyclopropane. $^1$H NMR: (500 MHz, $CDCl_3$) δ 7.32-7.22 (m, 2H), 7.18-7.13 (m, 1H), 7.09-7.05 (m, 2H), 5.54 (ddd, J=17.0, 10.3, 8.5 Hz, 1H), 5.10 (dd, J=17.0, 1.5 Hz, 1H), 4.93 (dd, J=10.2, 1.5 Hz, 1H), 1.93 (ddd, J=9.3, 5.7, 4.4 Hz, 1H), 1.70 (tt, J=8.7, 4.9 Hz, 1H), 1.20 (dt, J=8.5, 5.4 Hz, 1H), 1.11 (dt, J=8.8, 5.3 Hz, 1H).

Method P (Synthesis of Dibenzyl 2-vinylcyclopropane-1,1-dicarboxylate)

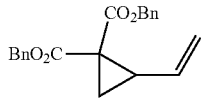

Dibenzyl 2-vinylcyclopropane-1,1-dicarboxylate

To a nitrogen-purged flask charged with 1,4-dibromo-2-butene (1.0 g, 4.7 mmol, 1.0 equiv) and $Cs_2CO_3$ (3.8 g, 11.7 mmol, 2.5 equiv) were added THF (23 mL) and dibenzyl malonate (1.1 mL, 4.7 mmol, 1 equiv). The mixture was stirred at 60° C. overnight. Upon cooling, the mixture was filtered through Celite, washed with saturated aqueous $NaHCO_3$, water, and brine. The combined organic layer was separated, dried over anhydrous $Na_2SO_4$ and concentrated. Purification of the residue by flash column chromatography gave the title compound (1.1 g, 69% yield). $^1$H NMR: (300 MHz, $CDCl_3$) δ 7.40-7.18 (m, 10H), 5.51-5.00 (m, 7H), 2.63 (dd, J=8.2, 7.4 Hz, 1H), 1.76 (dd, J=7.7, 4.9 Hz, 1H), 1.60 (dd, J=9.0, 4.9 Hz, 1H).

Spectral Data for Diazide Products

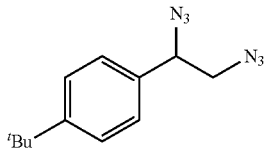

1-(tert-Butyl)-4-(1,2-diazidoethyl)benzene

Followed Method A from p-tert-butylstyrene (32.0 mg, 0.20 mmol), for 2 h, at room temperature, with 5 mol % $MnBr_2.4H_2O$, using $LiClO_4$ as the electrolyte, with 400 μL HOAc, using Pt plate counter electrode, and purified using silica gel chromatography to give 44.0 mg (90% yield) of the title compound as a pale yellow oil. IR (Film): 2964, 2869, 2096, 1510, 1462, 1440, 1397, 1312, 1268, 1109, 1015, 831, 658 $cm^{-1}$; $^1$H NMR: (400 MHz, $CDCl_3$) δ 7.41 (d, J=8.3 Hz, 2H), 7.24 (d, J=8.2 Hz, 2H), 4.64 (dd, J=8.4, 4.8 Hz, 1H), 3.52-3.39 (m, 2H), 1.31 (s, 9H); $^{13}$C NMR: (101 MHz, $CDCl_3$) δ 152.07, 133.24, 126.58, 125.96, 65.30, 55.92, 34.64, 31.22; MS (DART) exact mass calculated for $[C_{12}H_{17}N_6^+—N_2]$: 217.1448, found 217.1447.

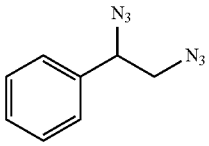

(1,2-Diazidoethyl)benzene

Followed Method A from styrene (20.8 mg, 0.20 mmol), for 2 h, at room temperature, with 5 mol % $MnBr_2.4H_2O$, using $LiClO_4$ as the electrolyte, with 400 μL HOAc, using Pt plate counter electrode, and purified using silica gel chromatography to give 35.7 mg (95% yield) of the title compound as a pale yellow oil. IR (Film): 2917, 2849, 2092, 1441, 1310, 1254, 905, 856, 758, 738, 698, 657 $cm^{-1}$; $^1H$ NMR: (400 MHz, $CDCl_3$) δ 7.44-7.33 (m, 5H), 4.68 (dd, J=8.1, 5.0 Hz, 1H), 3.54-3.42 (m, 2H); $^{13}C$ NMR: (101 MHz, $CDCl_3$) δ 136.29, 129.08, 129.04, 126.92, 65.51, 55.94; MS (DART) exact mass calculated for $[C_8H_9N_6^+—N_2]$: 161.0822, found 161.0821.

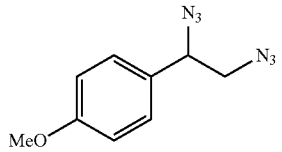

1-(1,2-Diazidoethyl)-4-methoxybenzene

Followed Method A from p-methoxystyrene (26.8 mg, 0.20 mmol), for 4 h, at room temperature, with 5 mol % $MnBr_2.4H_2O$, using $LiClO_4$ as the electrolyte, with 400 μL HOAc, using Pt plate counter electrode, and purified using silica gel chromatography to give 36.6 mg (84% yield) of the title compound as a colorless oil. IR (Film): 2961, 2918, 2839, 2005, 1161, 1513, 1246, 1032, 830 $cm^{-1}$; $^1H$ NMR: (500 MHz, $CDCl_3$) δ 7.22-7.15 (m, 2H), 6.89-6.83 (m, 2H), 4.55 (dd, J=8.3, 5.0 Hz, 1H), 3.75 (s, 3H), 3.41 (dd, J=12.7, 8.3 Hz, 1H), 3.34 (dd, J=12.7, 5.0 Hz, 1H); $^{13}C$ NMR: (126 MHz, $CDCl_3$) δ 160.06, 128.25, 114.43, 65.02, 55.85, 55.30; MS (DART) exact mass calculated for $[C_9H_{11}N_6O^+—N_2]$: 191.0927, found 191.0923.

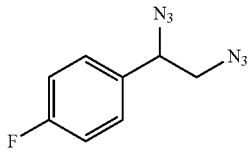

1-(1,2-Diazidoethyl)-4-fluorobenzene

Followed Method A from p-fluorostyrene (24.4 mg, 0.20 mmol), for 3 h, at room temperature, with 5 mol % $MnBr_2.4H_2O$, using $LiClO_4$ as the electrolyte, with 400 μL HOAc, using Pt plate counter electrode, and purified using silica gel chromatography to give 35.0 mg (85% yield) of the title compound as a colorless oil. IR (Film): 2919, 2850, 2100, 1604, 1511, 1226, 1159, 1101, 1015, 834 $cm^{-1}$; $^1H$ NMR: (500 MHz, $CDCl_3$) δ 7.36-7.29 (m, 2H), 7.14-7.08 (m, 2H), 4.66 (dd, J=8.0, 5.1 Hz, 1H), 3.49 (dd, J=12.7, 8.1 Hz, 1H), 3.43 (dd, J=12.7, 5.0 Hz, 1H); $^{13}C$ NMR: (126 MHz, $CDCl_3$) δ 163.91, 161.93, 132.22, 132.20, 128.79, 128.72, 116.19, 116.01, 64.75, 55.93; MS (DART) exact mass calculated for $[C_8H_8FN_6^+—N_2]$: 179.0728, found 179.0735.

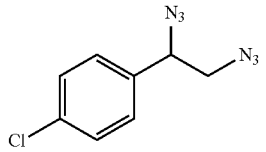

1-Chloro-4-(1,2-diazidoethyl)benzene

Followed Method A from p-chlorostyrene (27.7 mg, 0.20 mmol), for 3 h, at room temperature, with 5 mol % $MnBr_2.4H_2O$, using $LiClO_4$ as the electrolyte, with 400 μL HOAc, using Pt plate counter electrode, and purified using silica gel chromatography to give 38.3 mg (86% yield) of the title compound as a colorless oil. IR (Film): 2361, 2343, 2098, 1493, 1260, 1092, 1015, 826 $cm^{-1}$; $^1H$ NMR: (500 MHz, $CDCl_3$) δ 7.36-7.29 (m, 2H), 7.25-7.17 (m, 2H), 4.58 (dd, J=8.0, 5.0 Hz, 1H), 3.41 (dd, J=12.7, 8.1 Hz, 1H), 3.35 (dd, J=12.7, 5.0 Hz, 1H); $^{13}C$ NMR: (126 MHz, $CDCl_3$) δ 134.96, 134.87, 129.30, 128.30, 64.77, 55.85; MS (DART) exact mass calculated for $[C_8H_8ClN_6^+—N_2]$: 195.0432, found 195.0440, 197.0410.

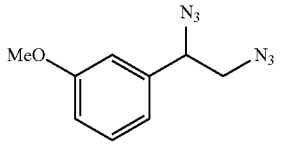

1-(1,2-Diazidoethyl)-3-methoxybenzene

Followed Method A from m-methoxystyrene (26.8 mg, 0.20 mmol), for 3 h, at room temperature, with 10 mol % $MnBr_2.4H_2O$, using $TBAPF_6$ as the electrolyte, with 400 μL HOAc, using Pt plate counter electrode, and purified using silica gel chromatography to give 28.8 mg (66% yield) of the title compound as a colorless oil. IR (Film): 2957, 2921, 2850, 2099, 1602, 1587, 1491 $cm^{-1}$; $^1H$ NMR: (500 MHz, $CDCl_3$) δ 7.33 (t, J=7.9 Hz, 1H), 6.91 (dd, J=8.0, 2.0 Hz, 2H), 6.87 (d, J=1.7 Hz, 1H), 4.64 (dd, J=8.3, 4.9 Hz, 1H), 3.83 (s, 3H), 3.49 (dd, J=12.7, 8.4 Hz, 1H), 3.43 (dd, J=12.7, 4.9 Hz, 1H); $^{13}C$ NMR: (126 MHz, $CDCl_3$) δ 160.07, 137.85, 130.16, 119.12, 114.33, 112.65, 65.47, 55.94, 55.32; MS (DART) exact mass calculated for $[C_9H_{11}N_6O^+—N_2]$: 191.0927, found 191.0932.

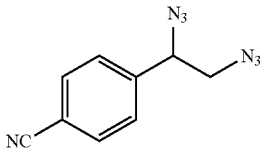

4-(1,2-Diazidoethyl)benzonitrile

Followed Method A from p-cyanostyrene (25.8 mg, 0.20 mmol), for 3 h, at room temperature, with 5 mol % $MnBr_2.4H_2O$, using $LiClO_4$ as the electrolyte, with 400 μL HOAc, using Pt plate counter electrode, and purified using silica gel chromatography to give 29.8 mg (70% yield) of the title compound as a colorless oil. IR (Film): 2923, 2851, 2231, 2105, 1339, 1258, 912, 837, 737 $cm^{-1}$; $^1H$ NMR: (300 MHz, $CDCl_3$) δ 7.72 (d, J=8.4 Hz, 2H), 7.47 (d, J=8.2 Hz, 2H), 4.83-4.64 (m, 1H), 3.55-3.43 (m, 2H); $^{13}C$ NMR: (75 MHz, $CDCl_3$) δ 141.56, 132.80, 127.70, 118.13, 112.92, 64.74, 55.73; MS (DART) exact mass calculated for $C_9H_8N_7^+$: 214.0836, found 214.0840.

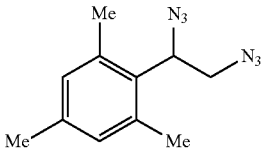

2-(1,2-Diazidoethyl)-1,3,5-trimethylbenzene

Followed Method A from 2,4,6-trimethylstyrene (29.2 mg, 0.20 mmol), for 2.5 h, at room temperature, with 5 mol % $MnBr_2.4H_2O$, using $LiClO_4$ as the electrolyte, with 400 μL HOAc, using Pt plate counter electrode, and purified using silica gel chromatography to give 40.5 mg (88% yield) of the title compound as a pale yellow oil. IR (Film): 2922, 2853, 2094, 1611, 1451, 1354, 1257, 852, 667 $cm^{-1}$; $^1H$ NMR: (500 MHz, $CDCl_3$) δ 6.88 (s, 2H), 5.18 (dd, J=9.5, 4.9 Hz, 1H), 3.70 (dd, J=12.8, 9.5 Hz, 1H), 3.34 (dd, J=12.8, 4.9 Hz, 1H), 2.42 (s, 6H), 2.27 (s, 3H); $^{13}C$ NMR: (126 MHz, $CDCl_3$) δ 138.30, 136.65, 130.50, 129.06, 62.10, 53.40, 20.79, 20.70; MS (DART) exact mass calculated for $[C_{11}H_{15}N_6^+—N_2]$: 203.1291, found 203.1295.

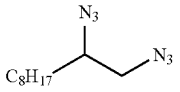

1,2-Diazidodecane

Followed Method A from 1,2-decene (28.1 mg, 0.20 mmol), for 4 h, at 40° C., with 5 mol % $MnBr_2.4H_2O$, using $LiClO_4$ as the electrolyte, with 300 μL, HOAc, using Pt mesh counter electrode, and purified using silica gel chromatography to give 39.0 mg (87% yield) of the title compound as a pale yellow oil. IR (Film): 2924, 2854, 2095, 1462, 1345, 1268, 723 $cm^{-1}$; $^1H$ NMR: (400 MHz, $CDCl_3$) δ 3.47-3.43 (m, 1H), 3.40-3.36 (m, 1H), 3.33-3.28 (m, 1H), 1.57-1.51 (m, 2H), 1.37-1.25 (m, 12H), 0.88 (t, J=6.5 Hz, 3H); $^{13}C$ NMR: (101 MHz, $CDCl_3$) δ 62.05, 54.81, 31.78, 31.74, 29.33, 29.26, 29.14, 25.85, 22.62, 14.07; MS (DART) exact mass calculated for $[C_{10}H_{21}N_6^+—N_2]$: 197.1761, found 197.1760.

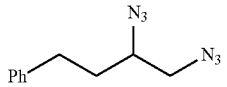

(3,4-Diazidobutyl)benzene

Followed Method A from but-3-en-1-ylbenzene (26.4 mg, 0.20 mmol), for 4 h, at 40° C., with 5 mol % $MnBr_2.4H_2O$, using $LiClO_4$ as the electrolyte, with 300 μL HOAc, using Pt mesh counter electrode, and purified using silica gel chromatography to give 35.9 mg (83% yield) of the title compound as a pale yellow oil. IR (Film): 2917, 2849, 2095, 1496, 1454, 1345, 1270, 748, 699 $cm^{-1}$; $^1H$ NMR: (400 MHz, $CDCl_3$) δ 7.32-7.29 (m, 2H), 7.26-7.14 (m, 3H), 3.44-3.31 (m, 3H), 2.84-2.77 (m, 1H), 2.75-2.60 (m, 1H), 1.84 (dd, J=14.7, 7.3 Hz, 2H); $^{13}C$ NMR: (101 MHz, $CDCl_3$) δ 140.32, 128.61, 128.35, 126.31, 61.08, 54.91, 33.36, 31.97; MS (DART) exact mass calculated for $[C_{10}H_{13}N_6^+—N_2]$: 189.1135, found 189.1134.

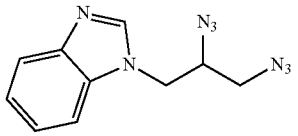

1-(2,3-Diazidopropyl)-1H-benzo[d]imidazole

Followed Method A from 1-allyl-1H-benzo[d]imidazole (31.6 mg, 0.20 mmol), for 4 h, at 40° C., with 5 mol % $MnBr_2.4H_2O$, using $LiClO_4$ as the electrolyte, with 400 μL HOAc, using Pt mesh counter electrode, and purified using silica gel chromatography to give 32.4 mg (67% yield) of the title compound as a pale yellow oil. IR (Film): 3059, 2924, 2853, 2100, 1615, 1495, 1287, 1261, 1205, 745 $cm^{-1}$; NMR: (300 MHz, $CDCl_3$) δ 7.94 (s, 1H), 7.89-7.78 (m, 1H), 7.49-7.38 (m, 1H), 7.37-7.29 (m, 2H), 4.36 (dd, J=14.8, 5.1 Hz, 1H), 4.22 (dd, J=14.8, 7.3 Hz, 1H), 4.00-3.92 (m, 1H), 3.54-3.39 (m, 2H); $^{13}C$ NMR: (75 MHz, $CDCl_3$) δ 143.69, 143.25, 123.50, 122.64, 120.75, 109.14, 60.34, 51.74, 45.55; MS (DART) exact mass calculated for $C_{10}H_{11}N_8^+$: 243.1101, found 243.1099.

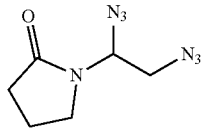

1-(1,2-Diazidoethyl)pyrrolidin-2-one

Followed Method A from 1-vinylpyrrolidin-2-one (22.2 mg, 0.20 mmol), for 2 h, at room temperature, with 5 mol % $MnBr_2.4H_2O$, using $LiClO_4$ as the electrolyte, with 400 μL HOAc, using Pt plate counter electrode, and purified using silica gel chromatography to give 38.2 mg (98% yield) of the title compound as a colorless oil. IR (Film): 2958, 2918, 2850, 2098, 1695, 1411, 1261, 1225, 1097, 1026, 900, 799, 661 $cm^{-1}$; NMR: (400 MHz, $CDCl_3$) δ 5.81 (t, J=6.6 Hz, 1H), 3.56-3.46 (m, 1H), 3.45-3.31 (m, 3H), 2.52-2.42 (m, 2H), 2.17-2.07 (m, 2H); $^{13}C$ NMR: (101 MHz, $CDCl_3$) δ 175.97, 66.78, 51.16, 42.34, 30.58, 18.14; MS (DART) exact mass calculated for $C_6H_{10}N_7O^+$: 196.0941, found 196.0940.

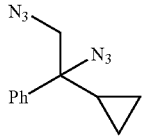

(1,2-Diazido-1-cyclopropylethyl)benzene

Followed Method A from (1-cyclopropylvinyl)benzene (28.8 mg, 0.20 mmol), for 3 h, at room temperature, with 5 mol % $MnBr_2.4H_2O$, using $LiClO_4$ as the electrolyte, with 400 μL HOAc, using Pt plate counter electrode, and purified using silica gel chromatography to give 39.2 mg (86% yield) of the title compound as a colorless oil. IR (Film): 3011, 2927, 2096, 1447, 1296, 1258, 1028, 762, 699 $cm^{-1}$; $^1H$ NMR: (300 MHz, $CDCl_3$) δ 7.72-7.29 (m, 5H), 3.75 (q, J=12.7 Hz, 2H), 1.47-1.32 (m, 1H), 0.73-0.60 (m, 2H), 0.60-0.42 (m, 2H); $^{13}C$ NMR: (75 MHz, $CDCl_3$) δ 138.45, 128.57, 128.31, 126.83, 68.79, 59.02, 17.92, 1.75, 1.44; MS (DART) exact mass calculated for $[C_{11}H_{13}N_6^+—N_2]$: 201.1135, found 201.1134.

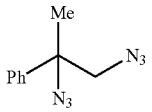

(1,2-Diazidopropan-2-yl)benzene

Followed Method A from prop-1-en-2-ylbenzene (23.6 mg, 0.20 mmol), for 2.75 h, at room temperature, with 5 mol % $MnBr_2.4H_2O$, using $TBAPF_6$ as the electrolyte, with 400 μL HOAc, using Pt plate counter electrode, and purified using silica gel chromatography to give 32.3 mg (80% yield) of the title compound as a colorless oil. IR (Film): 2982, 2928, 2102, 1494, 1447, 1381, 1299, 1251, 763, 699 $cm^{-1}$; $^1H$ NMR: (400 MHz, $CDCl_3$) δ 7.45-7.40 (m, 4H), 7.38-7.30 (m, 1H), 3.50 (d, J=12.6 Hz, 1H), 3.40 (d, J=12.5 Hz, 1H), 1.77 (s, 3H); $^{13}C$ NMR: (101 MHz, $CDCl_3$) δ 140.55, 128.84, 128.28, 125.74, 66.53, 60.98, 22.29; MS (DART) exact mass calculated for $[C_9H_{11}N_6^+—N_2]$: 175.0978, found 175.0977.

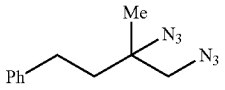

(3,4-Diazido-3-methylbutyl)benzene

Followed Method A from (3-methylbut-3-en-1-yl)benzene (29.2 mg, 0.20 mmol), for 2 h, at 40° C., with 5 mol % $MnBr_2.4H_2O$, using $LiClO_4$ as the electrolyte, with 300 μL HOAc, using Pt mesh counter electrode, and purified using silica gel chromatography to give 41.9 mg (91% yield) of the title compound as a pale yellow oil. IR (Film): 2970, 2918, 2099, 1456, 1383, 1259, 1067, 1029, 801, 746, 699 $cm^{-1}$; $^1H$ NMR: (400 MHz, $CDCl_3$) δ 7.29-7.07 (m, 5H), 3.32-3.17 (m, 2H), 2.61 (dd, J=15.3, 7.0 Hz, 2H), 1.81-1.75 (m, 2H), 1.30 (s, 3H); $^{13}C$ NMR: (101 MHz, $CDCl_3$) δ 141.01, 128.55, 128.24, 126.17, 63.52, 59.03, 39.39, 30.13, 21.25; MS (DART) exact mass calculated for $[C_{11}H_{15}N_6^+—N_2]$: 203.1291, found 203.1291.

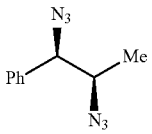

syn-(1,2-Diazidopropyl)benzene

Followed Method A from prop-1-en-1-ylbenzene (23.6 mg, 0.20 mmol), for 2 h, at 40° C., with 5 mol % $MnBr_2.4H_2O$, using $LiClO_4$ as the electrolyte, with 400 μL HOAc, using Pt plate counter electrode, and purified using silica gel chromatography to give 38.4 mg (95% yield, 3:1 dr) of the title compound as a colorless oil. IR (Film): 2918, 2849, 2099, 1493, 1453, 1380, 1255, 756, 700 $cm^{-1}$; $^1H$ NMR: (400 MHz, $CDCl_3$) δ 7.50-7.12 (m, 5H), 4.53 (d, J=5.8 Hz, 1H), 3.90-3.51 (m, 1H), 1.26 (d, J=6.5 Hz, 3H); $^{13}C$ NMR: (101 MHz, $CDCl_3$) δ 136.00, 128.96, 128.81, 127.52, 69.60, 61.00, 15.01; MS (DART) exact mass calculated for $[C_9H_{11}N_6^+—N_2]$: 175.0978, found 175.0977.

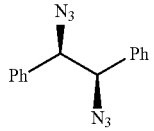

syn-1,2-Diazido-1,2-diphenylethane

Followed Method A from 1,2-diphenylethene (36.0 mg, 0.20 mmol), for 3 h, at room temperature, with 5 mol % $MnBr_2.4H_2O$, using $LiClO_4$ as the electrolyte, with 400 μL HOAc, using Pt plate counter electrode, and purified using silica gel chromatography to give 38.6 mg (73% yield, 2:1 dr) of the title compound as a colorless oil. IR (Film): 3065, 3032, 2096, 1493, 1454, 1248, 1076, 1029, 853, 757, 698 $cm^{-1}$; $^1H$ NMR: (500 MHz, $CDCl_3$) δ 7.34-7.27 (m, 2H), 7.21-7.12 (m, 5H), 7.03-6.95 (m, 3H), 4.56 (s, 2H); $^{13}C$ NMR: (126 MHz, $CDCl_3$) δ 135.81, 135.74, 128.93, 128.67, 128.63, 128.52, 127.92, 127.63, 70.70, 69.63; MS (DART) exact mass calculated for $[C_{14}H_{13}N_6^+—N_2]$: 237.1135, found 237.1129.

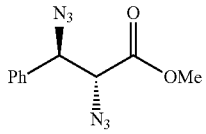

anti-Methyl-2,3-diazido-3-phenylpropanoate

Followed Method A from methyl cinnamate (32.4 mg, 0.20 mmol), for 3.5 h, at 40° C., with 10 mol % $MnBr_2.4H_2O$, using $LiClO_4$ as the electrolyte, with 400 μL HOAc, using Pt plate counter electrode, and purified using silica gel chromatography to give 45.3 mg (92% yield, 2:1 dr) of the title compound as a pale yellow oil. IR (Film): 2956, 2917, 2849, 2100, 1743, 1454, 1436, 1251, 1201, 1172, 1012, 762, 700 $cm^{-1}$; $^1H$ NMR: (500 MHz, $CDCl_3$) δ 7.46-7.36 (m, 5H), 4.91 (d, J=8.0 Hz, 1H), 4.11 (d, J=8.0 Hz, 1H), 3.82 (s, 3H); $^{13}C$ NMR: (126 MHz, $CDCl_3$) δ 168.13, 167.93, 134.86, 134.40, 129.42, 129.21, 128.97, 128.94, 127.75, 127.36, 66.25, 66.19, 65.48, 65.39, 52.89; MS (DART) exact mass calculated for $[C_{10}H_{11}N_6O_2^+—N_2]$: 219.0877, found 219.0876.

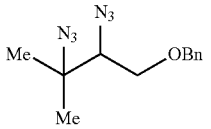

((2,3-Diazido-3-methylbutoxy)methyl)benzene

Followed Method A from benzyl prenyl ether (35.2 mg, 0.20 mmol), for 4.5 h, at room temperature, with 10 mol % $MnBr_2.4H_2O$, using $LiClO_4$ as the electrolyte, with 400 μL HOAc, using Pt plate counter electrode, and purified using silica gel chromatography to give 42.6 mg (82% yield) of the title compound as a colorless oil. IR (Film): 2977, 2919, 2872, 2096, 1454, 1370, 1329, 1262, 1144, 1076, 737, 698 $cm^{-1}$; $^1H$ NMR: (300 MHz, $CDCl_3$) δ 7.45-7.28 (m, 5H), 4.59 (d, J=2.7 Hz, 2H), 3.83 (dd, J=9.2, 2.0 Hz, 1H), 3.60-3.49 (m, 2H), 1.32 (s, 3H), 1.29 (s, 3H); $^{13}C$ NMR: (75 MHz, $CDCl_3$) δ 137.51, 128.46, 127.81, 127.55, 73.49, 69.93, 68.89, 62.09, 23.82, 22.96; MS (DART) exact mass calculated for $C_{12}H_{17}N_6O^+$: 261.1458, found 261.1456.

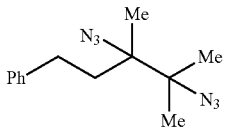

(3,4-Diazido-3,4-dimethylpentyl)benzene

Followed Method A from (3,4-dimethylpent-3-en-1-yl) benzene (34.8 mg, 0.20 mmol), for 4.0 h, at 40° C., with 5 mol % $MnBr_2.4H_2O$, using $LiClO_4$ as the electrolyte, with 300 μL HOAc, using Pt mesh counter electrode, and purified using silica gel chromatography to give 35.1 mg (68% yield) of the title compound as a colorless oil. IR (Film): 2980, 2931, 2871, 2102, 1464, 1379, 1265, 1112, 1064, 797, 753, 700 $cm^{-1}$; NMR: (500 MHz, $CDCl_3$) δ 7.53-6.88 (m, 5H), 2.74-2.55 (m, 2H), 1.87-1.78 (m, 1H), 1.73-1.61 (m, 1H), 1.33 (s, 3H), 1.28 (s, 3H), 1.27 (s, 3H); $^{13}C$ NMR: (126 MHz, $CDCl_3$) δ 141.60, 128.55, 128.38, 126.12, 68.58, 68.00, 37.56, 30.81, 22.24, 21.96, 17.67; MS (DART) exact mass calculated for $C_{13}H_{19}N_6^+$: 259.1666, found 259.1666.

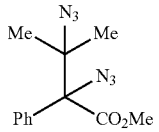

Methyl 2,3-diazido-3-methyl-2-phenylbutanoate

Followed Method A from methyl 3-methyl-2-phenylbut-2-enoate (38.0 mg, 0.20 mmol), for 2.5 h, at 40° C., with 5 mol % $MnBr_2.4H_2O$, using $LiClO_4$ as the electrolyte, with 300 μL HOAc, using Pt mesh counter electrode, and purified using silica gel chromatography to give 44.9 mg (82% yield) of the title compound as a pale yellow oil. IR (Film): 2986, 2954, 2918, 2106, 1740, 1263, 1231, 1150, 1035, 753, 705 $cm^{-1}$; $^1H$ NMR: (300 MHz, $CDCl_3$) δ 7.48-7.39 (m, 5H), 3.88 (s, 3H), 1.41 (s, 3H), 1.35 (s, 3H); $^{13}C$ NMR: (75 MHz, $CDCl_3$) δ 169.76, 133.64, 128.99, 128.42, 127.60, 78.89, 65.70, 53.03, 23.10; MS (DART) exact mass calculated for $C_{12}H_{15}N_6O_2^+$: 275.1251, found 275.1255.

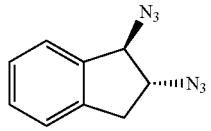

trans-1,2-Diazido-2,3-dihydro-1H-indene

Followed Method A from 1H-indene (23.2 mg, 0.20 mmol), for 3 h, at room temperature, with 5 mol % $MnBr_2.4H_2O$, using $LiClO_4$ as the electrolyte, with 300 μL HOAc, using Pt mesh counter electrode, and purified using silica gel chromatography to give 32.8 mg (82% yield, >19:1 dr) of the title compound as a pale yellow oil. IR (Film): 2917, 2849, 2094, 1461, 1345, 1318, 1253, 748 $cm^{-1}$; $^1H$ NMR: (500 MHz, $CDCl_3$) δ 7.34-7.16 (m, 4H), 4.70 (d, J=5.5 Hz, 1H), 4.10 (dd, J=12.7, 6.7 Hz, 1H), 3.28 (dd, J=16.0, 7.3 Hz, 1H), 2.87 (dd, J=16.0, 6.5 Hz, 1H); $^{13}C$ NMR: (126 MHz, $CDCl_3$): δ 139.10, 137.75, 129.48, 127.76, 125.14, 124.57, 70.28, 67.66, 36.13 ppm; MS (DART) exact mass calcd for $[C_9H_9N_6^+—N_2]$: 173.0822, found 173.0822.

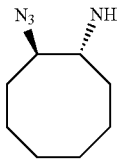

trans-1,2-Diazidocyclooctane

Followed Method A from cyclooctene (22.0 mg, 0.20 mmol), for 3.5 h, at room temperature, with 5 mol % $MnBr_2.4H_2O$, using $TBAPF_6$ as the electrolyte, with 300 μL HOAc, using Pt plate counter electrode, and purified using silica gel chromatography to give 30.6 mg (79% yield, 4:1 dr) of the title compound as a colorless oil. IR (Film): 3071, 2957, 2931, 2890, 2858, 2099, 1428, 1111, 823, 737, 702 $cm^{-1}$; $^1H$ NMR: (500 MHz, $CDCl_3$) δ 3.79-3.45 (m, 2H), 1.97-1.88 (m, 2H), 1.88-1.70 (m, 5H), 1.70-1.60 (m, 2H), 1.61-1.47 (m, 3H), 1.46-1.32 (m, 2H); $^{13}C$ NMR: (126 MHz, $CDCl_3$) δ 66.57, 63.42, 29.26, 28.13, 26.44, 25.57, 24.71, 23.46; MS (DART) exact mass calculated for $[C_8H_{15}N_6^+—N_2]$: 167.1291, found 167.1297.

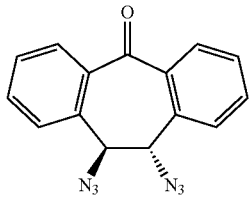

trans-10,11-Diazido-10,11-dihydro-5H-dibenzo[a,d][7]annulen-5-one

Followed Method A from 5H-dibenzo[a,d][7]annulen-5-one (41.2 mg, 0.20 mmol), for 5 h, at 40° C., with 5 mol % $MnBr_2.4H_2O$, using $LiClO_4$ as the electrolyte, with 400 μL HOAc, using Pt mesh counter electrode, and purified using silica gel chromatography to give 36.0 mg (62% yield, 2:1 dr) of the title compound as a pale yellow oil. IR (Film): 2921, 2850, 2098, 1656, 1597, 1296, 1245, 932, 760, 719 $cm^{-1}$; $^1H$ NMR: (500 MHz, $CDCl_3$) δ 8.10-7.91 (m, 2H), 7.68-7.36 (m, 6H), 5.16 (s, 1H), 5.01 (s, 1H); $^{13}C$ NMR: (126 MHz, $CDCl_3$): δ 193.78, 193.08, 138.16, 137.51, 134.12, 133.73, 133.00, 132.93, 131.03, 130.91, 130.43, 129.78, 129.33, 128.68, 127.23, 66.73, 66.29 ppm; MS (DART) exact mass calculated for $C_{15}H_{11}ON_6^+$: 291.0989, found 291.0985.

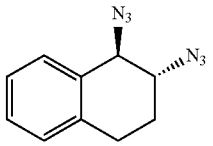

trans-1,2-Diazido-1,2,3,4-tetrahydronaphthalene

Followed Method A from 1,2-dihydronaphthalene (26.0 mg, 0.20 mmol), for 3 h, at room temperature, with 5 mol % $MnBr_2.4H_2O$, using $LiClO_4$ as the electrolyte, with 400 μL HOAc, using Pt plate counter electrode, and purified using silica gel chromatography to give 35.5 mg (83% yield, 10:1 dr) of the title compound as a pale yellow oil. IR (Film): 2936, 2846, 2093, 1490, 1455, 1294, 1256, 749 $cm^{-1}$; $^1H$ NMR: (300 MHz, $CDCl_3$) δ 7.37 (dd, J=8.2, 4.7 Hz, 1H), 7.33-7.21 (m, 2H), 7.21-7.09 (m, 1H), 4.44 (d, J=6.6 Hz, 1H), 3.96-3.80 (m, 1H), 3.01-2.83 (m, 2H), 2.30-2.20 (m, 1H), 2.04-1.92 (m, 1H); $^{13}C$ NMR: (75 MHz, $CDCl_3$): δ 135.61, 131.46, 128.97, 128.95, 128.52, 126.69, 63.45, 61.51, 25.96, 25.08 ppm; MS (DART) exact mass calculated for $C_{10}H_{11}N_6^+$: 215.1040, found 215.1033.

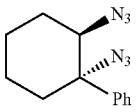

trans-(1,2-Diazidocyclohexyl)benzene

Followed Method A from 2,3,4,5-tetrahydro-1,1'-biphenyl (31.6 mg, 0.20 mmol), for 2 h, at 40° C., with 5 mol % $MnBr_2.4H_2O$, using $LiClO_4$ as the electrolyte, with 400 μL HOAc, using Pt plate counter electrode, and purified using silica gel chromatography to give 42.6 mg (88% yield, dr=10:1) of the title compound as a colorless oil. IR (Film): 2940, 2864, 2093, 1447, 1280, 1253, 698 $cm^{-1}$; $^1H$ NMR: (300 MHz, $CDCl_3$) δ 7.68-7.30 (m, 5H), 3.78 (s, 1H), 2.51-2.23 (m, 1H), 2.18-1.99 (m, 2H), 1.91-1.66 (m, 3H), 1.65-1.51 (m, 2H); $^{13}C$ NMR: (75 MHz, $CDCl_3$): δ 140.97, 128.73, 128.36, 126.50, 67.70, 65.23, 27.55, 26.48, 21.07, 19.26 ppm; MS (DART) exact mass calculated for $[C_{12}H_{15}N_6^+—N_2]$: 215.1291, found 215.1291.

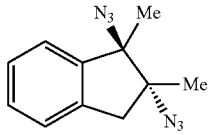

trans-(1,2-Diazido-1,2-dimethyl-2,3-dihydro-1H-indene

Followed Method A from 2,3-dimethyl-1H-indene (28.8 mg, 0.20 mmol), for 2 h, at room temperature, with 5 mol % $MnBr_2.4H_2O$, using $LiClO_4$ as the electrolyte, with 400 μL HOAc, using Pt plate counter electrode, and purified using silica gel chromatography to give 32.8 mg (72% yield, >19:1 dr) of the title compound as a colorless oil. IR (Film): 2925, 2851, 2096, 1454, 1376, 1257, 1061, 760, 733 $cm^{-1}$; $^1H$ NMR: (300 MHz, $CDCl_3$) δ 7.56-7.10 (m, 4H), 3.18-3.01 (m, 2H), 1.63 (s, 3H), 1.54 (s, 3H); $^{13}C$ NMR: (126 MHz, $CDCl_3$): δ 142.32, 139.47, 129.30, 127.40, 125.20, 122.99, 75.33, 74.63, 42.59, 18.21, 17.79 ppm; MS (DART) exact mass calculated for $[C_{11}H_{13}N_6^+—N_2]$: 201.1135, found 201.1134.

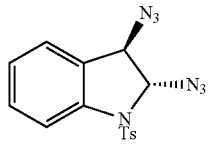

trans-2,3-Diazido-1-tosylindoline

Followed Method A from 1-tosyl-1H-indole (54.0 mg, 0.20 mmol), for 6.5 h, at room temperature, with 5 mol % $MnBr_2.4H_2O$, using $LiClO_4$ as the electrolyte, with 400 μL HOAc, using Pt plate counter electrode, and purified using silica gel chromatography to give 49.0 mg (69% yield, 10:1 dr) of the title compound as a yellow oil. IR (Film): 2919, 2850, 2099, 1598, 1476, 1363, 1240, 1169, 666 $cm^{-1}$; $^1H$ NMR: (300 MHz, $CDCl_3$) δ 7.64 (dd, J=29.4, 8.2 Hz, 3H), 7.53-7.33 (m, 1H), 7.21-7.09 (m, 4H), 5.44 (s, 1H), 4.27 (s, 1H), 2.28 (s, 3H); $^{13}C$ NMR: (75 MHz, $CDCl_3$): δ 145.05, 140.74, 134.15, 131.46, 129.85, 127.12, 126.12, 126.05, 125.35, 116.87, 82.19, 65.16, 21.55 ppm; MS (DART) exact mass calculated for $C_{15}H_{14}O_2N_7S^+$: 356.0924, found 356.0934.

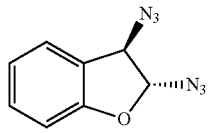

trans-2,3-Diazido-2,3-dihydrobenzofuran

Followed Method A from benzofuran (23.6 mg, 0.20 mmol), for 2 h, at room temperature, with 5 mol % $MnBr_2.4H_2O$, using $LiClO_4$ as the electrolyte, with 400 μL HOAc, using Pt plate counter electrode, and purified using silica gel chromatography to give 31.5 mg (78% yield, 9:1 dr) of the title compound as a yellow oil. IR (Film): 2094, 1615, 1600, 1476, 1466, 1319, 1224, 1158, 947, 914, 751 $cm^{-1}$; $^1H$ NMR: (300 MHz, $CDCl_3$) δ 7.45-7.31 (m, 2H), 7.13-6.93 (m, 2H), 5.79 (d, J=0.9 Hz, 1H), 4.63 (s, 1H); $^{13}C$ NMR: (75 MHz, $CDCl_3$): δ 158.56, 131.71, 125.61, 122.61, 121.97, 111.36, 96.95, 66.36 ppm; MS (DART) exact mass calculated for $[C_8H_7ON_6^+—N_2]$: 175.0614, found 175.0611.

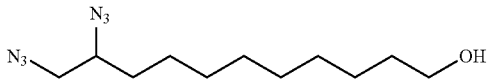

10,11-Diazidoundecan-1-ol

Followed Method A from undec-10-en-1-ol (34.0 mg, 0.20 mmol), for 4 h, at room temperature, with 10 mol % $MnBr_2.4H_2O$, using $LiClO_4$ as the electrolyte, with 400 μL HOAc, using Pt plate counter electrode, and purified using silica gel chromatography to give 41.1 mg (81% yield) of the title compound as a pale yellow oil. IR (Film): 3343, 2926, 2855, 2096, 1457, 1345, 1262, 1055, 910, 723, 625 $cm^{-1}$; $^1H$ NMR: (400 MHz, $CDCl_3$): δ 3.64 (t, J=6.6 Hz, 2H), 3.50-3.41 (m, 1H), 3.38 (dd, J=12.6, 4.0 Hz, 1H), 3.30 (dd, J=12.6, 7.4 Hz, 1H), 1.58-1.51 (m, 2H), 1.46-1.25 (m, 14H); $^{13}C$ NMR: (101 MHz, $CDCl_3$): δ 62.99, 62.01, 54.78, 32.70, 31.70, 29.38, 29.30, 29.26, 29.20, 25.81, 25.66 ppm; MS (DART) exact mass calculated for $C_{11}H_{23}ON_6^+$: 255.1928, found 255.1925.

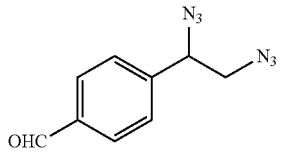

4-(1,2-Diazidoethyl)benzaldehyde

Followed Method A from 4-vinylbenzaldehyde (26.4 mg, 0.20 mmol), for 2 h, at room temperature, with 5 mol % $MnBr_2.4H_2O$, using $LiClO_4$ as the electrolyte, with 400 μL HOAc, using Pt plate counter electrode, and purified using silica gel chromatography to give 30.2 mg (70% yield) of the title compound as a pale yellow oil. IR (Film): 2921, 2850, 2740, 2094, 1699, 1608, 1579, 1304, 1254, 1208, 1169, 1014, 826, 728, 656 $cm^{-1}$; $^1H$ NMR: (300 MHz, $CDCl_3$): δ 10.03 (s, 1H), 7.93 (d, J=8.2 Hz, 2H), 7.52 (d, J=8.2 Hz, 2H), 4.76 (dd, J=7.3, 5.5 Hz, 1H), 3.57-3.45 (m, 2H); $^{13}C$ NMR: (75 MHz, $CDCl_3$): δ 191.43, 142.82, 136.65, 130.32, 127.60, 65.02, 55.77 ppm; MS (DART) exact mass calculated for $C_9H_9ON_6^+$: 217.0832, found 217.0832.

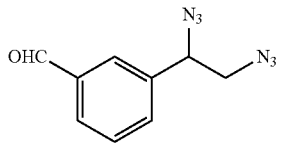

3-(1,2-Diazidoethyl)benzaldehyde

Followed Method A from 3-vinylbenzaldehyde (26.4 mg, 0.20 mmol), for 2 h, at room temperature, with 5 mol % $MnBr_2.4H_2O$, using $LiClO_4$ as the electrolyte, with 400 μL HOAc, using Pt plate counter electrode, and purified using silica gel chromatography to give 35.0 mg (81% yield) of the title compound as a pale yellow oil. IR (Film): 2924, 2850, 2738, 2095, 2698, 1605, 1587, 1332, 1143, 916, 800, 697, 650 $cm^{-1}$; NMR: (300 MHz, $CDCl_3$): δ 10.04 (s, 1H), 7.97-7.79 (m, 2H), 7.66-7.57 (m, 2H), 4.77 (dd, J=7.4, 5.5 Hz, 1H), 3.57-3.47 (m, 2H); $^{13}C$ NMR: (75 MHz, $CDCl_3$): δ 191.54, 137.70, 136.91, 132.76, 130.50, 129.83, 127.66, 64.83, 55.83 ppm; MS (DART) exact mass calculated for $C_9H_9ON_6^+$: 217.0832, found 217.0833.

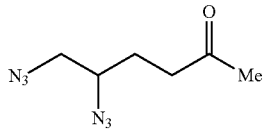

5,6-Diazidohexan-2-one

Followed Method A from hex-5-en-2-one (19.6 mg, 0.20 mmol), for 4 h, at 40° C., with 5 mol % $MnBr_2.4H_2O$, using $LiClO_4$ as the electrolyte, with 300 μL HOAc, using Pt mesh counter electrode, and purified using silica gel chromatography to give 31.3 mg (86% yield) of the title compound as a yellow oil. IR (Film): 2957, 2920, 2850, 2099, 1716, 1457, 1359, 1261, 801 $cm^{-1}$; $^1H$ NMR: (500 MHz, $CDCl_3$) δ 3.60-3.48 (m, 1H), 3.44 (dd, J=12.7, 4.0 Hz, 1H), 3.34 (dd, J=12.7, 7.4 Hz, 1H), 2.62-2.59 (m, 2H), 2.18 (s, 3H), 1.91-1.84 (m, 1H), 1.73-1.61 (m, 1H); $^{13}C$ NMR: (126 MHz, $CDCl_3$): δ 207.06, 61.07, 54.99, 39.23, 30.00, 25.58 ppm; MS (DART) exact mass calculated for $C_6H_{11}ON_6^+$: 183.0989, found 183.0989.

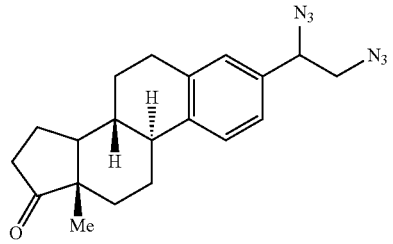

3-(1,2-Diazidoethyl)-3-deoxyestrone

Followed Method A from 3-vinyl-3-deoxyestrone (56.0 mg, 0.20 mmol), for 2.5 h, at 40° C., with 5 mol % $MnBr_2.4H_2O$, using $LiClO_4$ as the electrolyte, with 400 μL HOAc, using Pt plate counter electrode, and purified using silica gel chromatography to give 51.7 mg (71% yield, 1:1 dr) of the title compound as a white solid. IR (Film): 2925, 2857, 2094, 1736, 1324, 1257, 1084, 1008, 823 $cm^{-1}$; $^1H$ NMR: (500 MHz, $CDCl_3$) δ 7.33 (d, J=8.1 Hz, 1H), 7.10 (d, J=8.1 Hz, 1H), 7.05 (s, 1H), 4.61 (dd, J=8.3, 4.8 Hz, 1H), 3.50 (dd, J=12.8, 8.5 Hz, 1H), 3.42 (dd, J=12.7, 4.8 Hz, 1H), 2.94 (dd, J=8.5, 3.7 Hz, 2H), 2.51 (dd, J=19.0, 8.7 Hz, 1H), 2.47-2.37 (m, 1H), 2.37-2.26 (m, 1H), 2.22-2.11 (m, 1H), 2.11-2.02 (m, 2H), 2.01-1.93 (m, 1H), 1.67-1.46 (m, 6H), 0.92 (s, 3H); $^{13}C$ NMR: (126 MHz, $CDCl_3$): δ 220.63, 140.75, 137.39, 133.70, 127.50, 127.48, 126.07, 124.27, 124.23, 65.31, 65.25, 55.87, 55.85, 50.48, 47.92, 44.35, 37.95, 35.81, 31.54, 29.38, 29.37, 26.33, 25.61, 21.56, 13.81 ppm; MS (DART-ESI) exact mass calculated for $C_{20}H_{25}N_6O^+$: 365.2084, found 365.2080.

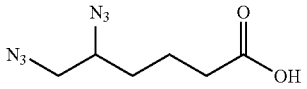

5,6-Diazidohexanoic acid

Followed Method A from hex-5-enoic acid (22.8 mg, 0.20 mmol), for 6 h, at room temperature, with 10 mol % $MnBr_2.4H_2O$, using $LiClO_4$ as the electrolyte, with 400 μL HOAc, using Pt plate counter electrode, and purified using silica gel chromatography to give 30.8 mg (78% yield) of the title compound as a yellow oil. IR (Film): 2922, 2852, 2096, 1704, 1444, 1413, 1255, 911, 819, 761, 660 $cm^{-1}$; $^1H$ NMR: (300 MHz, $CDCl_3$): δ 11.16 (s, 1H), 3.72-3.16 (m, 3H), 2.42 (t, J=6.9 Hz, 2H), 1.53-1.85 (m, 4H); $^{13}C$ NMR: (75 MHz, $CDCl_3$): δ 179.32, 61.63, 54.72, 33.39, 30.99, 20.94 ppm; MS (DART) exact mass calculated for $C_6H_{11}O_2N_6^+$: 199.0938, found 199.0938.

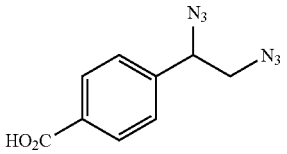

4-(1,2-Diazidoethyl)benzoic acid

Followed Method A from 4-vinylbenzoic acid (29.6 mg, 0.20 mmol), for 2.5 h, at room temperature, with 5 mol % $MnBr_2.4H_2O$, using $LiClO_4$ as the electrolyte, with 400 μL HOAc, using Pt plate counter electrode, and purified using silica gel chromatography to give 34.8 mg (75% yield) of the title compound as a pale yellow oil. IR (Film): 2922, 2852, 2669, 2548, 2095, 1686, 1610, 1424, 1319, 1289, 1253, 942, 859, 795, 772, 705 $cm^{-1}$; $^1H$ NMR: (300 MHz, $CDCl_3$): δ 8.17 (d, J=8.2 Hz, 2H), 7.47 (d, J=8.2 Hz, 2H), 4.76 (dd, J=7.4, 5.4 Hz, 1H), 3.70-3.28 (m, 2H); $^{13}C$ NMR: (75 MHz, $CDCl_3$): δ 171.49, 142.23, 130.95, 129.91, 127.11, 65.06, 55.83 ppm; MS (DART) exact mass calculated for $C_9H_9O_2N_6^+$: 233.0781, found 233.0776.

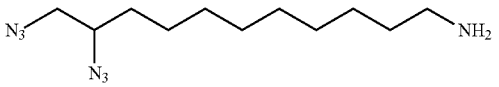

10,11-Diazidoundecan-1-amine

Followed Method A from undec-10-en-1-amine (33.8 mg, 0.20 mmol), for 5 h, at room temperature, with 10 mol % $MnBr_2.4H_2O$, using $LiClO_4$ as the electrolyte, with 400 μL HOAc, using Pt plate counter electrode, and purified using silica gel chromatography to give 39.0 mg (77% yield) of the title compound as a yellow oil. IR (Film): 3333, 2927, 2855, 2096, 1658, 1462, 1345, 1270, 1098, 724, 623 $cm^{-1}$; $^1H$ NMR: (300 MHz, $CDCl_3$): δ 3.59-3.11 (m, 5H), 2.70 (s, 2H), 1.54-1.11 (m, 16H); $^{13}C$ NMR: (75 MHz, $CDCl_3$): δ 62.00, 54.77, 41.03, 31.67, 30.16, 29.25, 29.21, 29.16, 29.09, 26.51, 25.78 ppm; MS (DART) exact mass calculated for $C_{11}H_{24}N_7^+$: 254.2088, found 254.2086.

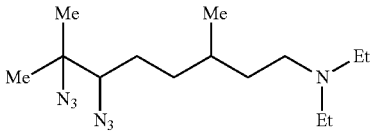

6,7-Diazido-N,N-diethyl-3,7-dimethyloctan-1-amine

Followed Method A from N,N-diethyl-3,7-dimethyloct-6-en-1-amine (42.2 mg, 0.20 mmol), for 5 h, at room temperature, with 10 mol % $MnBr_2.4H_2O$, using $LiClO_4$ as the electrolyte, with 400 μL HOAc, using Pt plate counter electrode, and purified using silica gel chromatography to give 40.7 mg (69% yield, 1:1 dr) of the title compound as a yellow oil. IR (Film): 2969, 2930, 2873, 2095, 1650, 1464, 1371, 1259, 1144, 1067, 643 $cm^{-1}$; $^1H$ NMR: (300 MHz, $CDCl_3$): δ 3.02 (d, J=9.9 Hz, 1H), 2.58-2.41 (m, 6H), 1.68-1.31 (m, 7H), 1.29 (d, J=6.4 Hz, 6H), 1.02 (t, J=7.1 Hz, 6H), 0.92-0.89 (m, 3H); $^{13}C$ NMR: (75 MHz, $CDCl_3$): δ 71.22, 70.89, 64.57, 50.61, 46.76, 34.58, 34.34, 33.95, 33.38, 31.36, 31.14, 27.01, 26.88, 22.93, 22.88, 22.86, 19.86, 19.46, 11.43 ppm; MS (DART) exact mass calculated for $C_{14}H_{30}N_7^+$: 296.2557, found 296.2555.

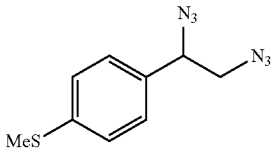

(4-(1,2-Diazidoethyl)phenyl)(methyl)sulfane

Followed Method A from methyl(4-vinylphenyl)sulfane (30.0 mg, 0.20 mmol), for 2 h, at room temperature, with 5 mol % $MnBr_2.4H_2O$, using $LiClO_4$ as the electrolyte, with 400 μL HOAc, using Pt plate counter electrode, and purified using silica gel chromatography to give 38.4 mg (82% yield) of the title compound as a yellow oil. IR (Film): 2988, 2922, 2099, 1251, 1093, 817, 653; $cm^{-1}$; $^1H$ NMR: (500 MHz, $CDCl_3$): δ 7.23-7.14 (m, 4H), 4.55 (dd, J=8.2, 5.0 Hz, 1H), 3.41 (dd, J=12.7, 8.3 Hz, 1H), 3.34 (dd, J=12.7, 4.9 Hz, 1H), 2.42 (s, 3H); $^{13}C$ NMR: (126 MHz, $CDCl_3$): δ 139.91, 132.81, 127.37, 126.68, 65.06, 55.80, 15.46 ppm; MS (DART) exact mass calculated for $[C_9H_{11}N_6S^+—N_2]$: 207.0699, found 207.0694.

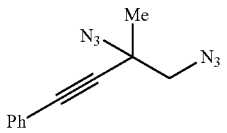

(3,4-Diazido-3-methylbut-1-yn-1-yl)benzene

Followed Method A from (3-methylbut-3-en-1-yn-1-yl) benzene (28.4 mg, 0.20 mmol), for 2 h, at room temperature, with 5 mol % $MnBr_2.4H_2O$, using $LiClO_4$ as the electrolyte, with 400 μL HOAc, using Pt plate counter electrode, and purified using silica gel chromatography to give 32.5 mg (72% yield) of the title compound as a pale yellow oil. IR (Film): 2987, 2925, 2851, 2100, 1490, 1444, 1305, 1272, 1247, 756, 690 $cm^{-1}$; $^1H$ NMR: (400 MHz, $CDCl_3$): δ 7.55-7.45 (m, 2H), 7.40-7.30 (m, 3H), 3.42 (dd, J=30.4, 12.4 Hz, 2H), 1.60 (s, 3H); $^{13}C$ NMR: (101 MHz, $CDCl_3$): δ 131.97, 129.09, 128.37, 121.30, 87.85, 84.88, 60.29, 59.76, 25.03 ppm; MS (DART) exact mass calculated for $[C_{11}H_{11}N_6^+—N_2]$: 199.0978, found 199.0979.

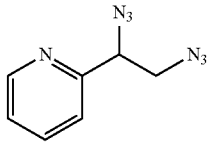

2-(1,2-Diazidoethyl)pyridine

Followed Method A from 2-vinylpyridine (21.0 mg, 0.20 mmol), for 2.5 h, at room temperature, with 5 mol % $MnBr_2.4H_2O$, using $LiClO_4$ as the electrolyte, with 400 μL HOAc, using Pt plate counter electrode, and purified using silica gel chromatography to give 36.0 mg (95% yield) of the title compound as an pale yellow oil. IR (Film): 2919, 2850, 2099, 1590, 1472, 1437, 1328, 1264, 749 $cm^{-1}$; $^1H$ NMR: (400 MHz, $CDCl_3$) δ 8.60 (d, J=4.1 Hz, 1H), 7.74 (td, J=7.7, 1.7 Hz, 1H), 7.39 (d, J=7.9 Hz, 1H), 7.33-7.20 (m, 1H), 4.69 (dd, J=7.1, 4.9 Hz, 1H), 3.79 (dd, J=12.7, 4.1 Hz, 1H), 3.66 (dd, J=12.7, 7.7 Hz, 1H); $^{13}C$ NMR: (101 MHz, $CDCl_3$) δ 155.77, 149.73, 137.19, 123.56, 121.94, 65.44, 54.45; MS (DART) exact mass calculated for $C_7H_8N_7^+$: 190.0836, found 190.0831.

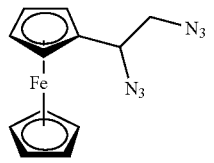

1,2-Diazidoethylferrocene

Followed Method A from vinylferrocene (42.4 mg, 0.20 mmol), for 2.5 h, at room temperature, with 5 mol % $MnBr_2.4H_2O$, using $LiClO_4$ as the electrolyte, with 400 μL HOAc, using Pt plate counter electrode. The reaction was monitored visually and via TLC. At approximately 95% completion via TLC the characteristic red/brown color of the reaction system developed a purple tint, indicating the formation of ferrocenium species (blue on TLC). Applied potential was stopped immediately and the product was purified using silica gel chromatography to give 45.0 mg (76% yield) of the title compound as an orange oil. IR (Film): 3095, 2925, 2850, 2097, 1314, 1264, 1106, 1002, 822 $cm^{-1}$; $^1H$ NMR: (500 MHz, $CDCl_3$) δ 4.43 (dd, J=8.6, 3.6 Hz, 1H), 4.29-4.09 (m, 9H), 3.57 (dd, J=12.7, 3.7 Hz, 1H), 3.46 (dd, J=12.6, 8.7 Hz, 1H); $^{13}C$ NMR: (126 MHz, $CDCl_3$) δ 84.80, 68.99, 68.59, 68.43, 66.99, 66.28, 61.93, 55.67; MS (DART) exact mass calculated for $C_{12}H_{12}FeN_6^+$: 296.0473, found 296.0476.

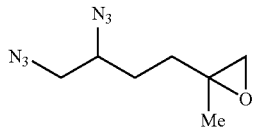

2-(3,4-Diazidobutyl)-2-methyloxirane

Followed Method A from 2-(but-3-en-1-yl)-2-methyloxirane (22.4 mg, 0.20 mmol), for 4 h, at 40° C., with 5 mol % $MnBr_2.4H_2O$, using $LiClO_4$ as the electrolyte, with 300 μL HOAc, using Pt mesh counter electrode, and purified using silica gel chromatography to give 28.3 mg (72% yield, 1:1 dr) of the title compound as a pale yellow oil IR (Film): 2957, 2922, 2851, 2098, 1452, 1271, 1066, 899, 803 $cm^{-1}$; $^1H$ NMR: (500 MHz, $CDCl_3$) δ 3.52-3.48 (m, 1H), 3.42 (dd, J=12.7, 4.1 Hz, 1H), 3.36-3.32 (m, 1H), 2.64-2.60 (m, 2H), 1.84-1.57 (m, 4H), 1.33 (s, 3H); $^{13}C$ NMR: (126 MHz, $CDCl_3$) δ 61.84, 61.65, 56.23, 56.12, 54.93, 54.67, 53.82, 53.38, 32.89, 32.47, 27.41, 27.11, 21.07, 20.71; MS (DART) exact mass calculated for $C_7H_{13}N_6O^+$: 197.1145, found 197.1143.

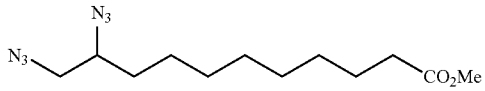

Methyl 10,11-diazidoundecanoate

Followed Method A from methyl undec-10-enoate (40.0 mg, 0.20 mmol), for 4 h, at 40° C., with 5 mol % $MnBr_2.4H_2O$, using $LiClO_4$ as the electrolyte, with 300 μL HOAc, using Pt mesh counter electrode, and purified using silica gel chromatography to give 46.9 mg (83% yield) of the title compound as a yellow oil. IR (Film): 2929, 2856, 2097, 1736, 1437, 1348, 1257, 1172, 1106 $cm^{-1}$; $^1H$ NMR: (500 MHz, $CDCl_3$) δ 3.65 (s, 3H), 3.47-3.42 (m, 1H), 3.39-3.36 (m, 1H), 3.32-3.24 (m, 1H), 2.29 (t, J=7.5 Hz, 2H), 1.65-1.57 (m, 2H), 1.55-1.50 (m, 2H), 1.46-1.25 (m, 10H); $^{13}C$ NMR: (126 MHz, $CDCl_3$) δ 174.20, 61.99, 54.78, 51.39, 34.00, 31.69, 29.14, 29.11, 29.03, 28.99, 25.78, 24.83; MS (DART) exact mass calculated for $C_{12}H_{23}O_2N_6^+$: 283.1877, found 283.1874.

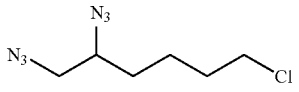

1,2-Diazido-6-chlorohexane

Followed Method A from 6-chlorohex-1-ene (23.7 mg, 0.20 mmol), for 5 h, at 40° C., with 5 mol % $MnBr_2.4H_2O$, using $LiClO_4$ as the electrolyte, with 300 μL HOAc, using Pt mesh counter electrode, and purified using silica gel chromatography to give 34.4 mg (85% yield) of the title compound as a colorless oil. IR (Film): 2917, 2849, 2096, 1446, 1346, 1262, 805, 740, 651 $cm^{-1}$; $^1H$ NMR: (400 MHz, $CDCl_3$) δ 3.62-3.52 (m, 2H), 3.52-3.44 (m, 1H), 3.44-3.23 (m, 2H), 1.92-1.73 (m, 2H), 1.71-1.44 (m, 4H); $^{13}C$ NMR:

(101 MHz, $CDCl_3$) δ 61.79, 54.74, 44.48, 32.07, 31.04, 23.24; MS (DART) exact mass calculated for $[C_6H_{12}ClN_6^+—N_2]$: 175.0745, found 175.0745, 177.0715.

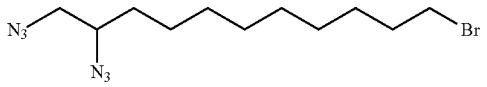

1,2-Diazido-11-bromoundecane

Followed Method A from 11-bromoundec-1-ene (46.6 mg, 0.20 mmol), for 5 h, at room temperature, with 10 mol % $MnBr_2.4H_2O$, using $LiClO_4$ as the electrolyte, with 400 μL, HOAc, using Pt plate counter electrode, and purified using silica gel chromatography to give 50.1 mg (79% yield) of the title compound as a yellow oil. IR (Film): 2927, 2855, 2096, 1463, 1346, 1268, 908, 723, 644 $cm^{-1}$; $^1H$ NMR: (300 MHz, $CDCl_3$) δ 3.57-3.18 (m, 5H), 1.91-1.79 (m, 2H), 1.62-1.48 (m, 2H), 1.47-1.24 (m, 13H); $^{13}C$ NMR: (75 MHz, $CDCl_3$) δ 62.00, 54.78, 34.02, 32.73, 31.70, 29.22, 29.18, 28.64, 28.07, 25.81; MS (DART) exact mass calculated for $[C_{11}H_{22}BrN_6^+—N_2]$: 289.1022, found 289.1019, 291.0998.

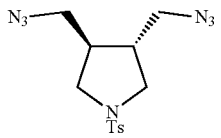

trans-3,4-Bis(azidomethyl)-1-tosylpyrrolidine

Followed Method A from N,N-diallyl-4-methylbenzenesulfonamide (50.1 mg, 0.20 mmol), for 5 h, at room temperature, with 10 mol % $MnBr_2.4H_2O$, using $LiClO_4$ as the electrolyte, with 400 μL, HOAc, using Pt plate counter electrode, and purified using silica gel chromatography to give 43.6 mg (65% yield, 2:1 dr) of the title compound as a colorless oil. IR (Film): 2922, 2852, 2096, 1597, 1452, 1341, 1270, 1161, 1091, 1040, 814, 662 $cm^{-1}$; $^1H$ NMR: (500 MHz, $CDCl_3$) δ 7.71 (dd, J=10.5, 8.3 Hz, 2H), 7.36 (d, J=8.0 Hz, 2H), 3.44-3.37 (m, 2H), 3.35-3.26 (m, 2H), 3.26-3.13 (m, 2H), 3.12-2.99 (m, 2H), 2.44 (s, 3H), 2.42-2.34 (m, 1H), 2.14-2.05 (m, 1H); $^{13}C$ NMR: (126 MHz, $CDCl_3$) δ 143.88, 133.30, 129.78, 127.46, 52.79, 50.57, 50.24, 49.57, 41.17, 39.78, 21.52; MS (DART) exact mass calculated for $C_{13}H_{18}O_2N_7S^+$: 336.1237, found 336.1233.

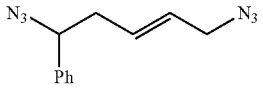

(E)-(1,4-Diazidobut-2-en-1-yl)benzene

Followed Method A from trans-2-phenyl-1-vinylcyclopropane (28.8 mg, 0.20 mmol), for 4 h, at room temperature, with 10 mol % $MnBr_2.4H_2O$, using $LiClO_4$ as the electrolyte, with 400 μL HOAc, using Pt plate counter electrode, and purified using silica gel chromatography to give 31.1 mg (68% yield, 5:1 E/Z ratio) of the title compound as a colorless oil. IR (Film): 2918, 2850, 2094, 1244, 973, 759, 700 $cm^{-1}$; $^1H$ NMR: (500 MHz, $CDCl_3$) δ 7.46-7.14 (m, 5H), 5.67-5.14 (m, 2H), 4.42 (t, J=7.1 Hz, 1H), 3.63 (d, J=6.0 Hz, 2H), 2.71-2.33 (m, 2H); $^{13}C$ NMR: (126 MHz, $CDCl_3$) δ 138.84, 131.11, 128.84, 128.42, 126.85, 126.78, 65.73, 52.45, 39.05; MS (DART) exact mass calculated for $C_{11}H_{13}N_6^+$: 229.1196, found 229.1195.

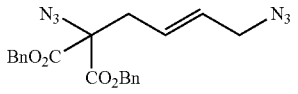

Dibenzyl (E)-2-azido-2-(4-azidobut-2-en-1-yl)malonate

Followed Method A from dibenzyl 2-vinylcyclopropane-1,1-dicarboxylate (67.2 mg, 0.20 mmol), for 4 h, at room temperature, with 10 mol % $MnBr_2.4H_2O$, using $LiClO_4$ as the electrolyte, with 400 μL HOAc, using Pt plate counter electrode, and purified using silica gel chromatography to give 61.3 mg (73% yield, 10:1 E/Z ratio) of the title compound as a colorless oil. IR (Film): 3035, 2959, 2922, 2101, 1744, 1456, 1217, 1185, 1116, 1028, 975, 907, 749, 697 $cm^{-1}$; $^1H$ NMR: (300 MHz, $CDCl_3$) δ 7.55-7.09 (m, 10H), 5.64-5.43 (m, 2H), 5.29-5.10 (m, 4H), 3.58 (d, J=5.8 Hz, 2H), 2.70 (d, J=6.7 Hz, 2H); $^{13}C$ NMR: (75 MHz, $CDCl_3$) δ 166.49, 134.40, 128.72, 128.63, 128.48, 127.45, 71.37, 68.40, 52.18, 36.83; MS (DART) exact mass calculated for $C_{21}H_{21}O_4N_6^+$: 421.1619, found 421.1610.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or device that "comprises", "has", "includes" or "contains" one or more steps or elements possesses those one or more steps or elements, but is not limited to possessing only those one or more steps or elements. Likewise, a step of a method or an element of a composition or article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed composition, device or method.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present invention have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the invention.

What is claimed is:

1. An electrochemical reaction method comprising:

immersing an anode and a cathode into a solution that includes azide ion (N3-), an alkene, and a transition metal catalyst;

passing a current through the anode; and forming a diazide from the alkene.

2. The method according to claim 1, wherein the formation of the diazide from the alkene does not proceed through an isolable intermediate compound.

3. The method according to claim 1, wherein the azide ion is derived from a group 1A azide salt.

4. The method according to claim 3, wherein the group 1A azide salt is sodium azide.

5. The method according to claim 1, wherein the transition metal catalyst is a Mn(II) catalyst.

6. The method according to claim 5, wherein the amount of the Mn(II) catalyst is sub-stoichiometric relative to the amount of the alkene.

7. The method according to claim 1, wherein the solution contains an additional non-azide electrolyte.

8. The method according to claim 7, wherein the additional non-azide electrolyte is a tetraalkylammonium salt or a group 1A salt.

9. The method according to claim 1, wherein the alkene and diazide include functional groups selected from the group consisting of: an alcohol, an aldehyde, a ketone, a carboxylic acid, an amine, a sulfide, an alkyne, ferrocene, an epoxide, an ester, and an alkyl halide, and wherein said functional groups remain chemically untransformed.

10. An electrochemical reaction method comprising:

immersing an anode and a cathode into a solution that includes azide ion ($N_3^-$), an alkene, and a transition metal catalyst, wherein the transition metal catalyst is a Mn(II) catalyst present in an amount that is sub-stoichiometric relative to the amount of the alkene;

passing a current through the anode;

forming a first Mn(II)-azide complex from the solution that includes the azide ion ($N_3^-$), alkene, and transition metal catalyst;

oxidizing the first Mn(II)-azide complex to a first Mn(III)-azide complex via electron transfer to the anode;

transferring a first azide group from the first Mn(III)-azide complex to the alkene;

forming both i) a radical azide intermediate from the alkene and ii) Mn(II);

forming a second Mn(II)-azide complex from the solution that includes the azide ion ($N_3^-$), alkene, and transition metal catalyst;

oxidizing the second Mn(II)-azide complex to a second Mn(III)-azide complex via electron transfer to the anode;

transferring a second azide group from the second Mn(III)-azide complex to the radical azide intermediate; and forming both i) a diazide from the radical azide intermediate and ii) Mn(II).

11. The method according to claim 10, wherein the diazide is a 1,2-diazide.

* * * * *